United States Patent [19]

Farley

[11] Patent Number: 4,924,941

[45] Date of Patent: May 15, 1990

[54] BI-DIRECTIONAL PRESSURE ASSISTED SEALING PACKERS

[75] Inventor: David L. Farley, Lafayette, La.

[73] Assignee: Completion Services, Inc., Lafayette, La.

[21] Appl. No.: 428,871

[22] Filed: Oct. 30, 1989

[51] Int. Cl.[5] ..... E21B 23/06

[52] U.S. Cl. ..... 166/134; 166/182; 166/195

[58] Field of Search ..... 166/387, 134, 182, 119, 166/123, 195

[56] References Cited

U.S. PATENT DOCUMENTS

| | | | |
|---|---|---|---|
| 3,584,684 | 6/1971 | Anderson et al. | 166/129 |
| 3,749,166 | 7/1973 | Young | 166/123 |
| 4,156,460 | 5/1979 | Crowe | 166/120 |
| 4,437,516 | 3/1984 | Cockrell | 166/120 |
| 4,693,309 | 9/1987 | Caskey | 166/123 |
| 4,862,957 | 9/1989 | Scranton | 166/51 |

*Primary Examiner*—William P. Neuder

*Attorney, Agent, or Firm*—Ned L. Conley; David A. Rose; Williem E. Shull

[57] ABSTRACT

Disclosed are packers for use with a gravel pack system in an oil or gas well. The packers are of both the releasable and non-releasable, or sump type. The packers are designed so that after they are set or actuated and they seal against the casing wall or the well bore, fluid pressure in either axial direction on the packer seal will increase the energizing force on the seals. This self-energizing feature is accomplished with selectively disposed and sized annular seals on telescoping members.

32 Claims, 27 Drawing Sheets

BI-DIRECTIONAL PRESSURE ASSISTED SEALING PACKERS

FIELD OF THE INVENTION

The invention is directed to improved packers particularly for use in a gravel pack system for an oil or gas well, the packers being self-energized so as to increase the seal energizing force as the fluid pressure increases irrespective of whether the fluid pressure is from above or below the packer.

BACKGROUND OF THE INVENTION

In oil and gas well drilling operations, if sand enters the production pipe or the area between the production pipe and the casing, a number of problems can follow. These problems include production loss caused by sand bridging in casing, tubing and/or flow lines; failure of casing or liners due to the removal of surrounding formation, compaction and erosion; abrasion of downhole and surface equipment; and the need to dispose of unconsolidated materials from the recovered hydrocarbons.

The sand usually comes from unconsolidated formations. Its entry can be controlled through chemical or mechanical means to prevent the occurrence of the foregoing problems. One mechanical means for preventing sand influx is the gravel pack.

Gravel packing is a method of forming a filter of gravel between the producing formation and the production pipe. In a cased well which has been completed by perforation, the gravel pack is normally situated between the production pipe and the casing. If used in an uncased or open hole, the gravel pack serves both as a filter and also to support the unconsolidated formation. It also assists in supporting the formation in a cased hole, though the support is less important as the casing serves most of the supporting function.

A gravel pack is formed around the production pipe and disposed adjacent the producing formation. A liner or screen, having a plurality of narrow, spaced-apart slots or screen-covered openings through which the formation fluids enter the production pipe from the formation, is attached around the production pipe. The screen surrounds a body of gravel which serves as a filter to screen out fine sand and other unconsolidated products as the well fluid flows from the formation into the production pipe. Fluids thus enter the production pipe relatively free of the sand or unconsolidated material from the producing formation. The gravel which surrounds the screen should be packed to sufficient height and volume to remain consolidated and not be displaced as it filters the in-flowing well fluid.

Isolating the gravel pack ensures that produced fluid does not flow between the production pipe and the casing (or between the production pipe and the well bore in an uncased well). Isolation is accomplished in part by placing a packer above the gravel pack. The packer seals in the area between the casing (or well bore) and the production pipe. The area below the gravel pack can be sealed to complete isolation either by locating another packer (preferably a non-releasable "sump packer") below the gravel pack, or by providing a bridge plug below the gravel pack. Once the gravel pack is isolated, the produced fluid, which is under pressure, is forced to flow through the gravel before entering the production pipe.

In the past, compression-set packers with lockdown features have been used to seal against the inside of the well casing or well bore. In such packers, slips are mechanically actuated to anchor the packer to the casing wall (or to the uncased well bore). The sealing elements, typically made of rubber, are then energized by compressing them between two shoulders disposed on the packer. One shoulder is typically provided by a shoe below the rubber sealing elements, and the other by one or more mandrels passing through the inside of the rubber sealing elements. A lock ring and ratchet system is often used to prevent the shoulders from slipping away from the seal energizing position.

It has been found that compression-set packers will leak at high pressures unless they include a means for increasing the seal energization, such as a pressure responsive self-energizing feature. Leakage occurs because even when a high setting force is used to set the packer seals, once the setting force is removed, the ratchet will retreat slightly before being arrested by the locking effect created when the sets of ratchet teeth mate firmly at the respective bases and apexes of each. This causes a loosening of the seal. Packers are also particularly prone to leak if fluid pressures on the packers are cycled from one direction to the other.

In a typical conventional packer used in the past, an increased energizing force will be applied to the rubber sealing elements from the mandrel or mandrels when fluid pressure is applied to the packer from one direction, but not when pressure is applied from the other direction. In cases where one mandrel is employed, the cross-sectional area of the mandrel is usually exposed to the pressure differential and creates an energizing force against the rubber sealing elements in one direction only. Leakage occurs when pressure is applied in the opposite direction, in which case there is typically no energizing force against the sealing elements resulting from pressure on the cross-sectional area of the mandrel. Where two or more mandrels are employed, in conventional packers there typically are seals between the mandrels, and the pressure differential acting on the combined cross-sectional areas of the mandrels provides the self-energizing force in the one direction, but again, typically not in the other direction.

There have been several suggested solutions in the past to the general problem of pressure-deactivation of well packers. Each of these proposed solutions attempts to increase the seal energizing force when fluid pressure is applied, in some cases from annulus pressure above or below the packer, and in at least one case from pressure applied through the central bore of the inner mandrel. An example of the former type of system is disclosed in U.S. Pat. No. 4,224,987, issued Sept. 30, 1980, to Allen. Allen discloses a well packer using a combination of an upper movable shoe and sleeve, and possibly some inner mandrel movement, to increase seal element energization from annulus pressure applied from above, and a movable piston to increase seal element energization from annulus pressure applied from below. An upper shoe and sleeve are slidably retained on the inner mandrel in engagement with the seal elements, and are responsive to fluid pressure applied from above. The upper shoe and sleeve move down in response to such pressure, further compressing the packer elements. From below, annulus pressure acts upwardly on a telescoping piston, forcing it further into engagement with the packer seals. Thus, the Allen device utilizes movable shoes/pistons both above and below the seal elements, and requires a plurality of moving sleeves, pistons, and other parts both above and below the seal elements in order to effect the disclosed self-energizing of the seals. Accordingly, the Allen device is unduly complicated and difficult to make and use, and, with its multiplicity of moving parts, more likely to experience malfunctions than simpler packers. Moreover, the Allen seal elements are actuated in such a way that the movable sleeves/pistons which effect the increased energization engage the seal elements across only a part of their diameters, causing extrusion of the elastomeric members around them at the upper and lower extremities of the stack of seal elements. Such extrusion around the sleeves and pistons can cause uneven stresses in or even damage to the seal elements, and could lead to seal failure. The Allen device does not simply divide up the mandrel cross-sectional area(s) to respond to fluid pressure differentials acting from both above and below the packer to increase seal energization, as does the present invention.

Another approach to self-energization of a well packer due to pressure applied from both above and below the packer is disclosed in U.S. Pat. No. 3,459,261, issued Aug. 5, 1969, to Cochran. The Cochran device discloses a floating sleeve on which the seal element is mounted, the floating sleeve being slidable between abutments and responsive to fluid pressure applied from above and below the packer to increase the endwise compression of the seal. Like the Allen device, the Cochran packer thus has movable shoes/sleeves both above and below the seal element, and is similarly unduly complicated. Moreover, since the sliding sleeve of Cochran must remain free to move alternately up and down in order to effect self-energizing in the event of pressure cycling, this increases the chances of a failure to self-energize in at least one direction, in the event, for example, that the sleeve were to become stuck or otherwise prevented from moving fully or properly in one direction or the other. As in the case of Allen, the Cochran patent does not disclose simply dividing up the mandrel cross-sectional area(s) to respond to fluid pressure differentials acting from both above and below the packer to increase seal energization, as does the present invention.

Another approach to increasing seal energization is disclosed in U.S. Pat. No. 4,423,777, issued Jan. 3, 1984, to Mullins et al. The Mullins patent discloses a pressure chamber within a packer with dual-acting pistons, one piston setting the slips and the other piston compressing the seal elements. In the event that the seal elements begin to loosen, for example through extrusion, the Mullins patent discloses pressuring up through the central bore of the tool to the pressure chamber therewithin, thereby forcing the upper piston further into engagement with the seal elements and increasing the energization thereof. The increased energization therefore does not result from annulus pressure alone, as does the increased energization in the present invention. The Mullins device is therefore not fully self-energizing. In addition, if the Mullins internal pressure chamber should leak or otherwise fail, there could be no further energizing of the seals in the event of loosening through extrusion or the like. As in the case of Allen and Cochran, the Mullins patent does not disclose simply dividing up the mandrel cross-sectional area(s) to respond to fluid pressure differentials acting from both above and below the packer to increase seal energization, as does the present invention.

The present invention accomplishes self-energization of a well packer having a locking feature by simply dividing up the total cross-sectional areas of the mandrels into two components, one component creating a reduced self-energizing force when pressure is applied in one direction, and another component also creating a self-energizing force when pressure is applied from the other direction. This is accomplished simply by selectively locating and sizing two sets of seals on a plurality of telescoping members, without the need for movable pistons on each side of the seal elements, or a floating sleeve within the seal elements, or a pressure chamber within the packer with dual-acting pistons or the like, as in the case of the patents discussed briefly above.

SUMMARY OF THE INVENTION

The invention includes compression-set packers which can be actuated to seal against a casing wall or a well bore, wherein the seal is further energized by fluid pressure acting axially with respect to the packer, irrespective of the axial direction of the applied fluid pressure. The packers of the present invention are of both releasable and non-releasable (or sump packer) type. The packers of the invention include slips around the packer perimeter which can be actuated to anchor the packer to the casing or well bore to prevent axial or rotational movement. The sealing elements, which are preferably made of rubber, are also situated on the perimeter of the packer. They are energized by compressing them between two shoulders, thereby forcing them radially outwardly to form a seal against the casing or well bore. A ratchet system prevents the shoulders from moving away from the seals. Thus, the seals are prevented from de-energizing once they are actuated.

The slips can be selectively actuated, for example, by engaging and moving a sleeve on the packers with a setting tool. Movement of the sleeve moves the ratchet and the shoulders, as well as intermediate elements, thereby actuating both the slips and the packer seals. The ratchet acts to hold the shoulders, as described above, as well as all other intermediate elements, to prevent their retreat to their original, deactuated positions.

Due to the nature of the ratchet system, once the setting tool is removed, the ratchet will retreat slightly, to the point where it locks, and cause a slight loosening of the packer seals. In order to prevent the seals from losing their energizing force, the packers also include a self-energizing system for increasing energizing force on the packer seals in response to applied fluid pressure. In this system, two sets of seals, one set spaced radially outwardly with respect to the other, seal around telescoping parts which are located between them. As stated above, the seals divide up the total cross-sectional areas of the packer mandrels into two components, one component creating a self-energizing force when pressure is applied in one direction, and another component also creating a self-energizing force when pressure is applied from the other direction. When fluid pressure is applied axially in one direction, the additional seal energizing force is equal to the cross-sectional area of an inner mandrel multiplied by the applied fluid pressure. When fluid pressure is applied in the opposite direction, an additional energizing force is also applied, that additional force being equal to the cross-sectional area between the seals (i.e., the cross-sectional area of an element mandrel) multiplied by the applied fluid pressure. Thus, as the fluid pressure increases from either above or below the packer of the present invention, the seal energizing force increases.

In the first three embodiments of the invention described herein, the increased energizing force is created by eliminating any seals between the mandrels and placing one seal between the I.D. of the rubber-supporting, movable shoe (one of the shoulders between which the seals are compressed) and the O.D. of the outer or element mandrel, and another seal between the shoe body (which is attached to the shoe) and the O.D. of the inner mandrel at a location spaced radially inwardly of the first seal. Any threaded connection or opening between these two seals must also be sealed. The diameter of the first seal is greater than the diameter of the second seal.

In the fourth embodiment of the invention described herein, an extension of the lower slip actuating sub comprises an element mandrel. The element mandrel is telescoped around and in sliding engagement with the inner mandrel. A rubber-supporting shoe is affixed to the slip actuating sub at the upper end of the element mandrel. The slip actuating sub, with the upper shoe and element mandrel integral therewith, is free to move axially on the inner mandrel to a limited extent. The element mandrel telescopes into an end sub on the end of the packer, attached to the inner mandrel and comprising a second, fixed shoulder against which the seals are compressed. One seal is disposed between the O.D. of the element mandrel and the I.D. of the end sub, and another seal is disposed between the I.D. of the element mandrel and the O.D. of the inner mandrel. The diameter of the first seal is greater than the diameter of the second seal.

The releasable packers of the invention, but not the sump packers, are each designed so that following actuation and seal energization they can be released, for example, by moving the sleeve in a direction opposite from the direction in which it is moved to actuate the packer. This movement removes the ratchet from the locked position, thereby allowing the shoulders and the various intermediate elements to move to their de-actuated positions. The seals are de-energized and the slips are released from their gripping position on the casing or well bore. The packer can then be removed by pulling it upwardly.

The sump packers of the invention are not releasable. In substantially all other respects, however, the sump packers function essentially the same as the releasable packers described above.

The present invention will now be described in further detail with reference to the drawings.

DESCRIPTION OF THE PREFERRED EMBODIMENTS

The invention relates to an improved packer adapted particularly for use in a gravel pack system for an oil or gas well. After the packer slips are set to hold it in place and the packer seals are actuated, exposure to fluid pressure from either above or below the packer increases the setting force on the rubber packing elements, so that as the pressure increases, the seal energizing force also increases. Thus, the seal between the packer and the casing wall (or well bore) remains tight, regardless of whether pressure is applied from above or below, and regardless of whether the pressure is cycled from one direction to the other.

The present invention uses a simplified seal system to accomplish the foregoing functions. The seal system divides the cross-sectional areas responsive to energizing fluid pressure into two force components, one component creating a self-energizing force when pressure is applied in one direction, and another component also creating a self-energizing force when pressure is applied from the other direction. This is accomplished with selective placement of two circumferential seals on telescoping members, one seal being spaced radially outwardly with respect to the other.

Figure 1:
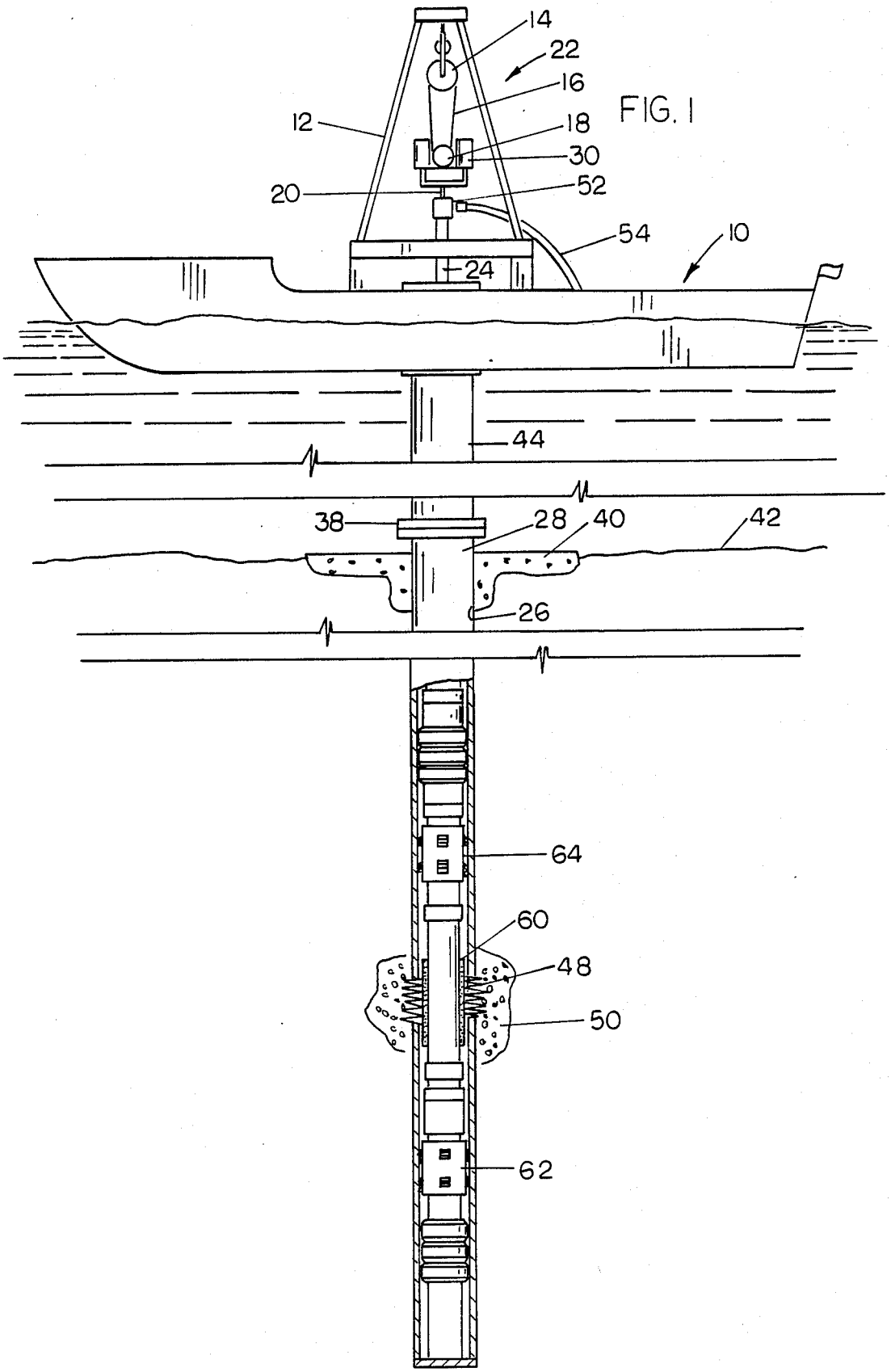
FIG. 1 shows an offshore drilling rig and surrounding environment with the packers of the invention in position above and below the producing zone.

Referring to the drawings, FIG. 1 shows an offshore well site illustrating a typical environment for the packers of the present invention. A floating drilling vessel or ship 10 has a drilling rig 22 which includes derrick 12 with a crown block 14, cable 16, and a travelling block 18. Travelling block 18 suspends a pipe swivel 20. A pipe string 24 is connected to the pipe swivel 20 and is suspended into the earth bore 26. The well site includes a motion compensator system 30, which provides constant tension on pipe string 24 while compensating for the wave-induced vertical motion of the floating drilling vessel 10.

Wellhead 38 is held in place at the ocean floor 42 by cement 40, and suspends well casing 28 within earth bore 26. A marine riser 44 extends from the well head 38 to floating vessel 10. The lower end of casing 28 is sealed by a sump packer 62 of the present invention.

Casing 28 is shown extending through production zone 50. Casing 28 has been perforated at 48 adjacent to production zone 50 to allow entry of produced fluids into casing 28 and pipe string 24. Although shown in operation in a cased hole with perforations in the casing, the present invention may also be used in an open hole well bore. Further, although shown in use in an offshore well site, the invention can be used similarly in a land-based drilling system.

A gravel pack system 60 is shown suspended on the lower end of pipe string 24 adjacent perforated casing 28 and production zone 50. The sump packer 62 of the invention is shown locked into position on casing 28 below gravel pack 60 and sealing the lower end of casing 28 and pipe string 24. A releasable packer 64 of the present invention is shown locked into position on casing 28 above gravel pack 60 and sealing casing 28 and pipe string 24 above gravel pack 60. In this manner, gravel pack 60 and production zone 50 are isolated between the packers 62 and 64. A head connection 52 at the upper end of pipe string 24 is connected to a slurry line 54 for introducing a fluid or slurry into the flow bore of the pipe string 24 for the gravel packing operation.

Referring to FIGS. 2–5, a releasable packer 100 of the invention is shown in the "running-in" or deactuated position, while FIGS. 6–9 illustrate the actuated or set position. As used in this application, the terms "up" and "down" refer to relative locations when the packers are in position in a well. Thus, "up" means towards the top of the well and "down" means the opposite direction. The term "axially" refers to either up or down, or to both up and down. "Out" means radially outwardly from the central axis of the packer, and "in" refers to the opposite direction.

Packer 100 includes an elongated tubular inner mandrel 112 with externally threaded pin ends 113, 115. Mandrel 112 has a ratchet surface 109 around a portion of its O.D. Pin end 113, located at the upper end of mandrel 112, is threaded to a lower box end 114 of a mandrel sleeve 118. Mandrel sleeve 118 includes a threaded box 117 at its upper end. Pin end 115, located at the lower end of mandrel 112, is threaded to a portion of the I.D. of a lower slip actuating sub 120. A seal 121 is positioned at the lowermost point of this threaded joint to seal the joint. Sub 120 has an upwardly and outwardly facing frustoconical ramp or cam surface 122 around its upper end.

A pin 124 at the lower end of sub 120 is threaded to a box end in the I.D. of a sub body 126. Sub body 126 has a lower pin end 128 of reduced O.D. and an upper portion 130. A series of circumferentially spaced apart set screws 131, which are disposed in radially extending threaded bores 133 in upper portion 130 and abut the outer surface of sub 120, aid in securing sub body 126 to sub 120.

Figure 2:
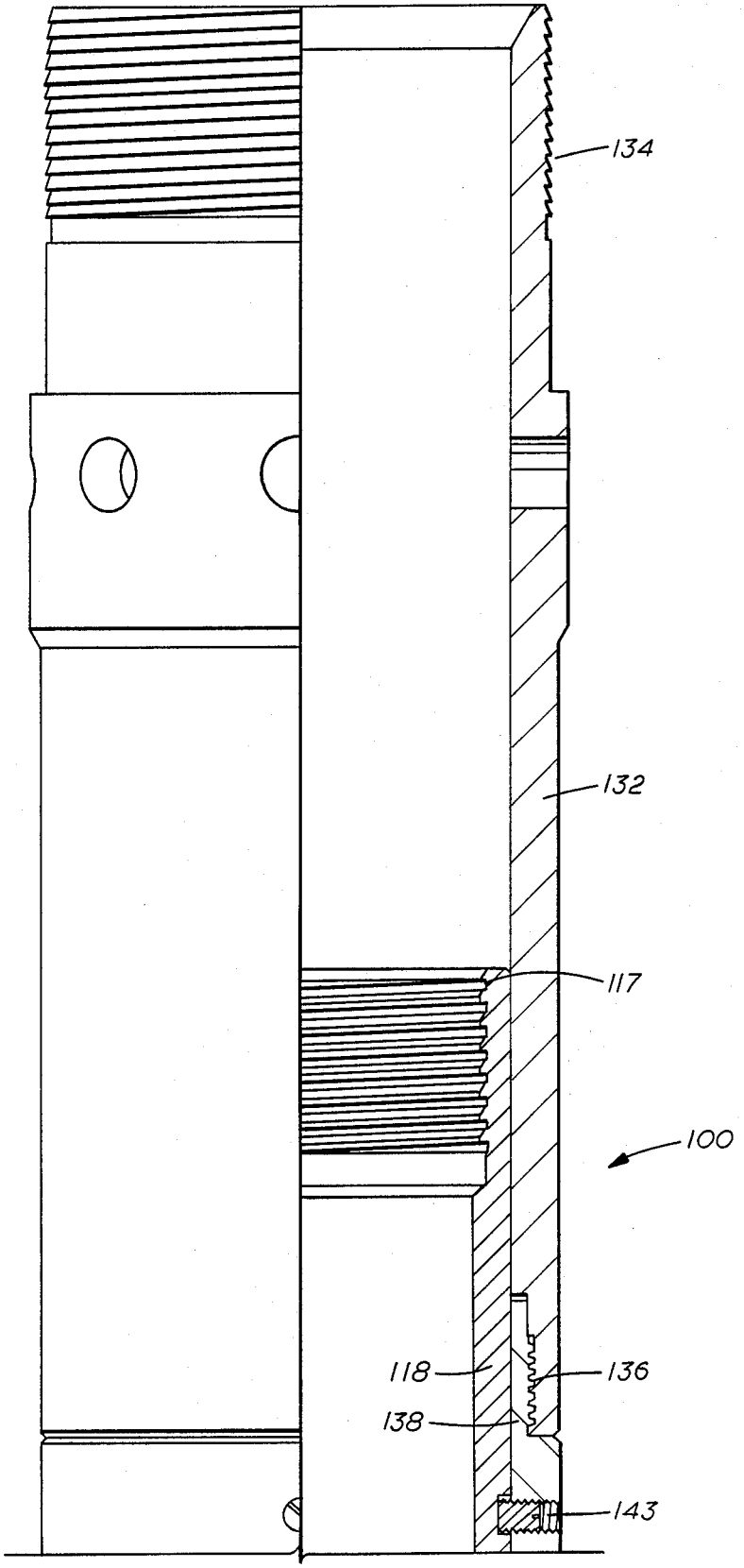
FIGS. 2–5 partially sectional side elevational views of one embodiment of a releasable packer of the invention shown in the running in position.
Figure 3:
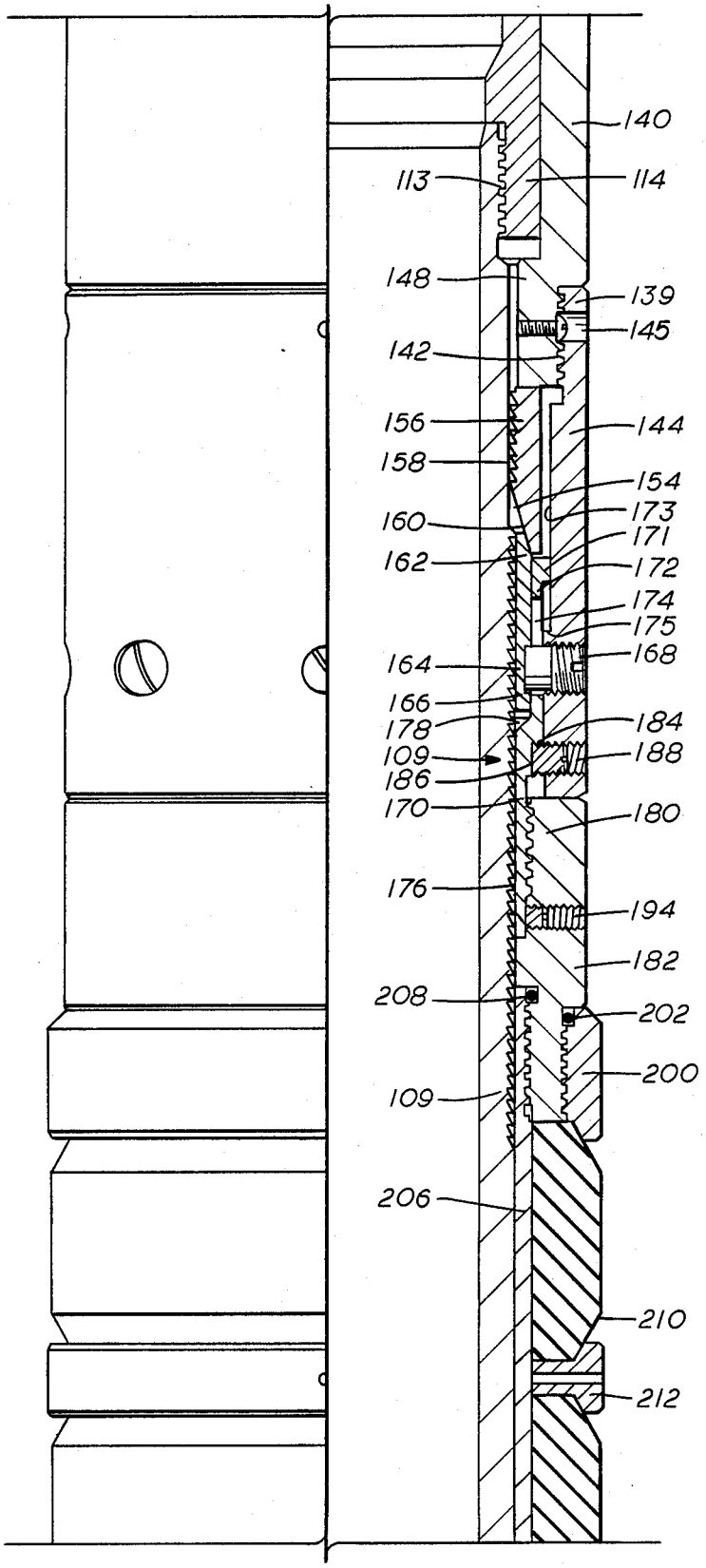
Figure 4:
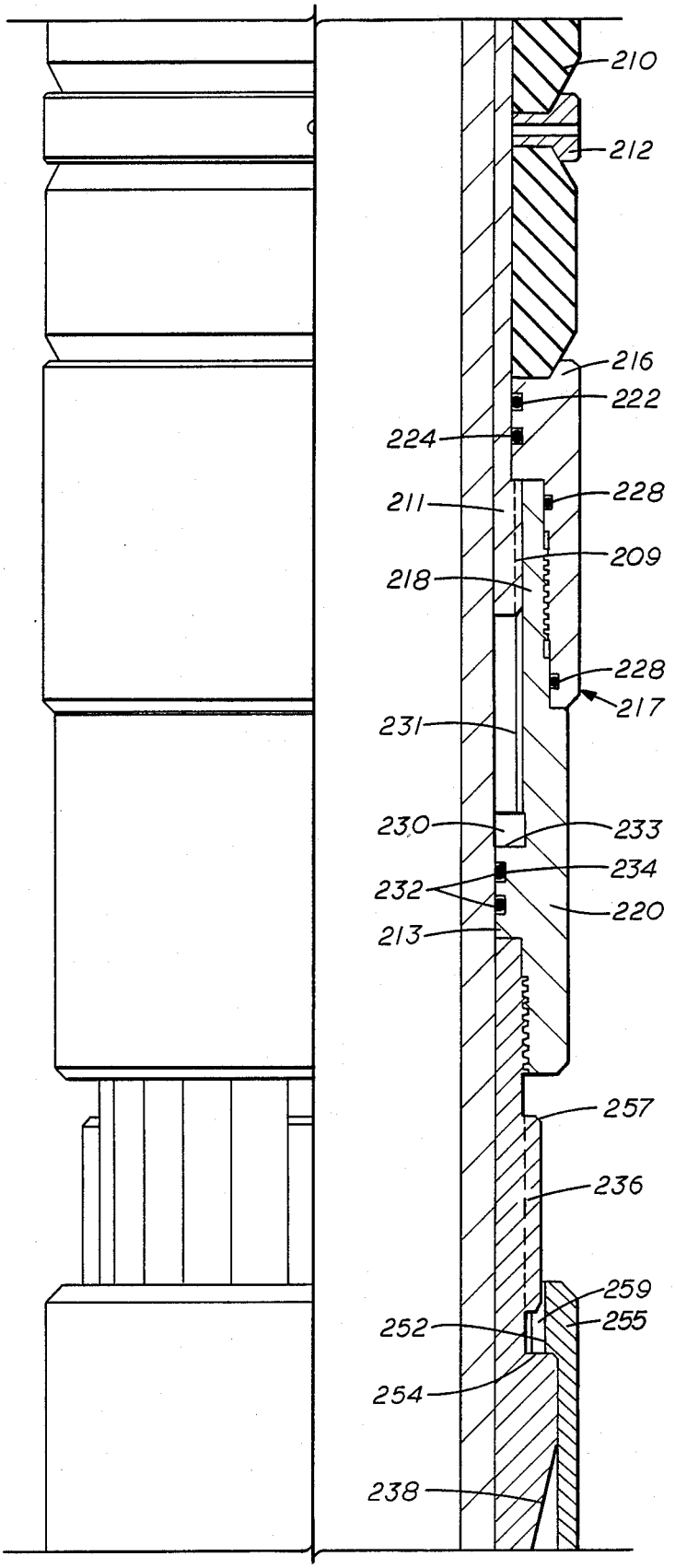
Figure 5:
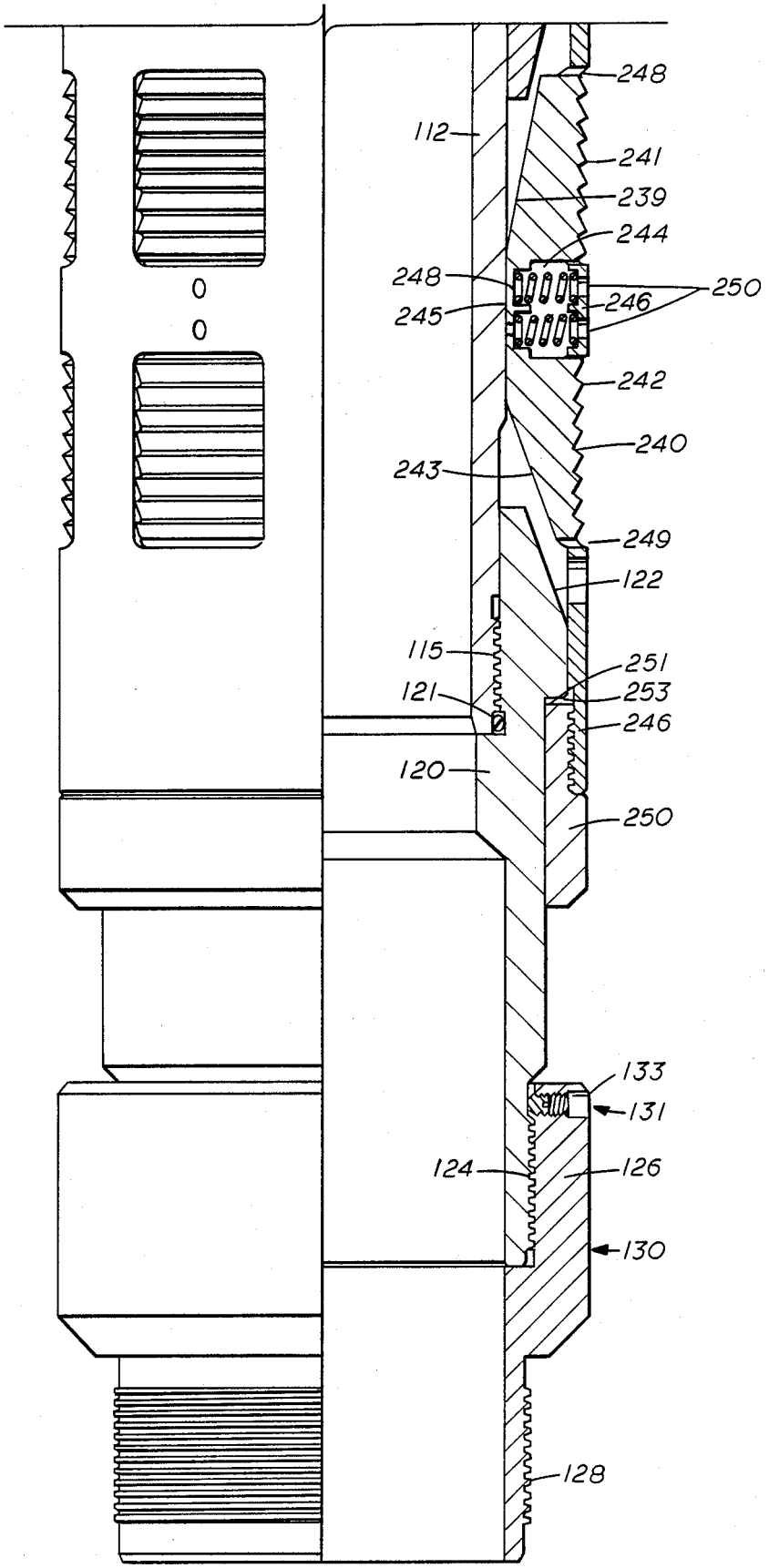
Figure 6:
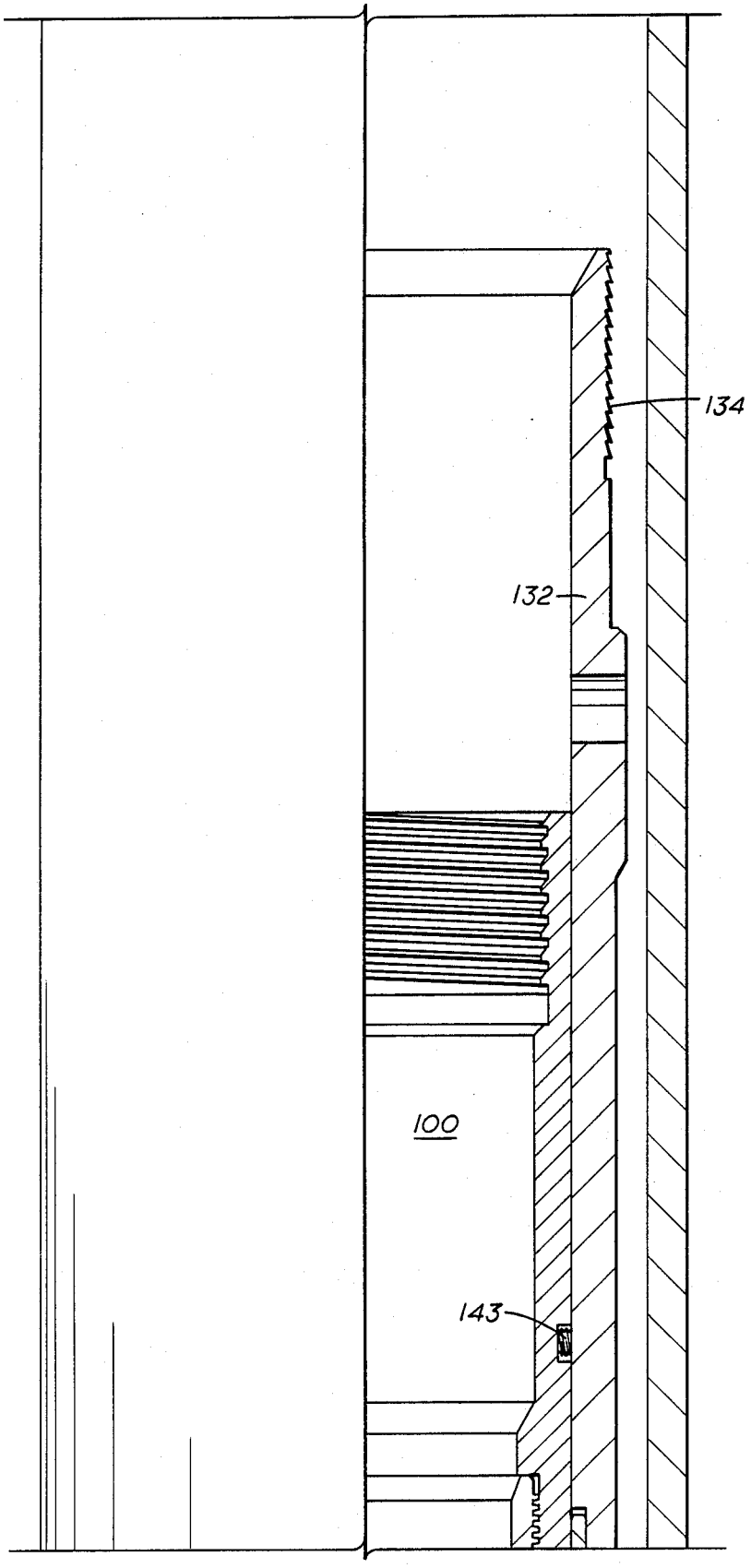
FIGS. 6–9 are partially sectional side elevational views of the releasable packer of FIGS. 2–5 in the actuated position.
Figure 7:
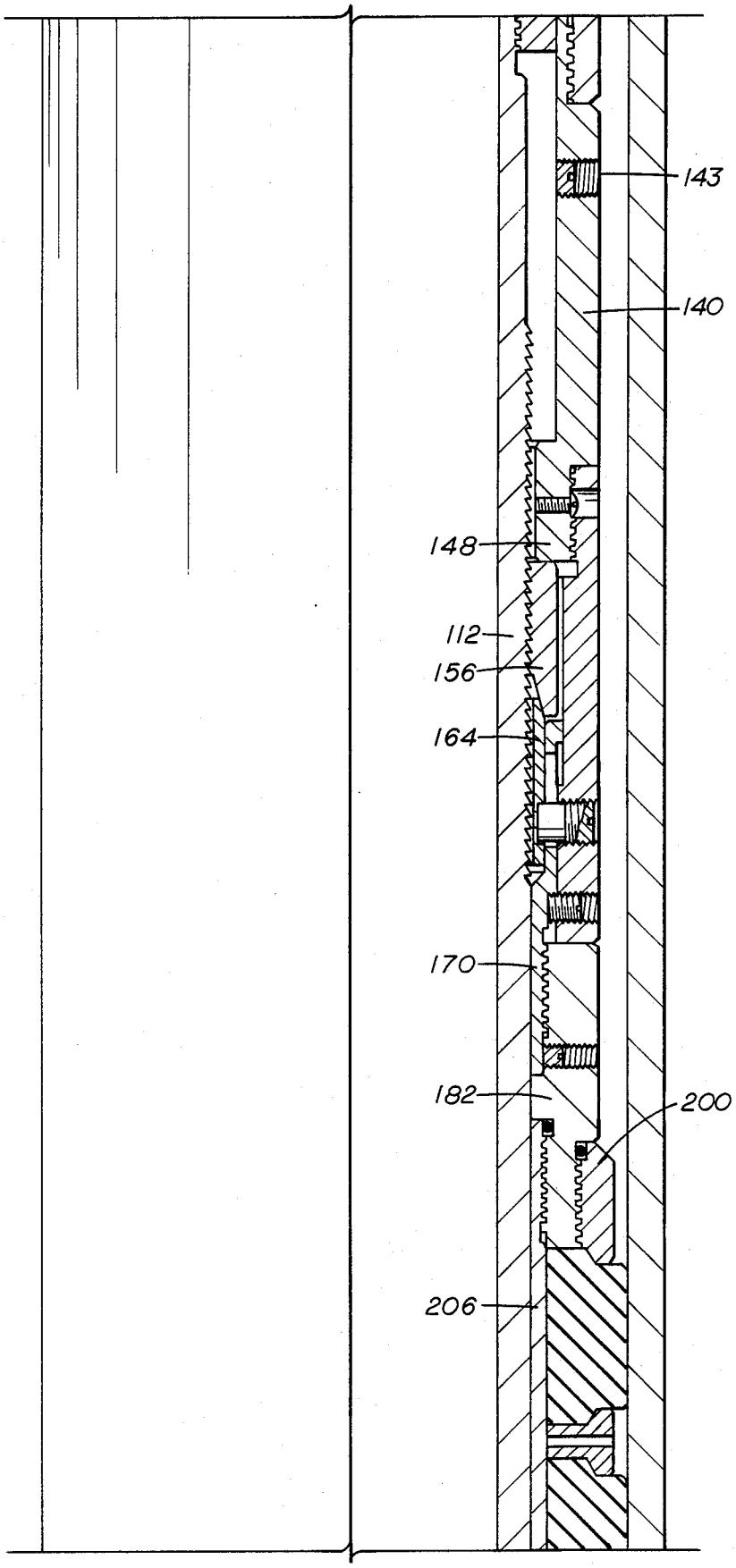
Figure 8:
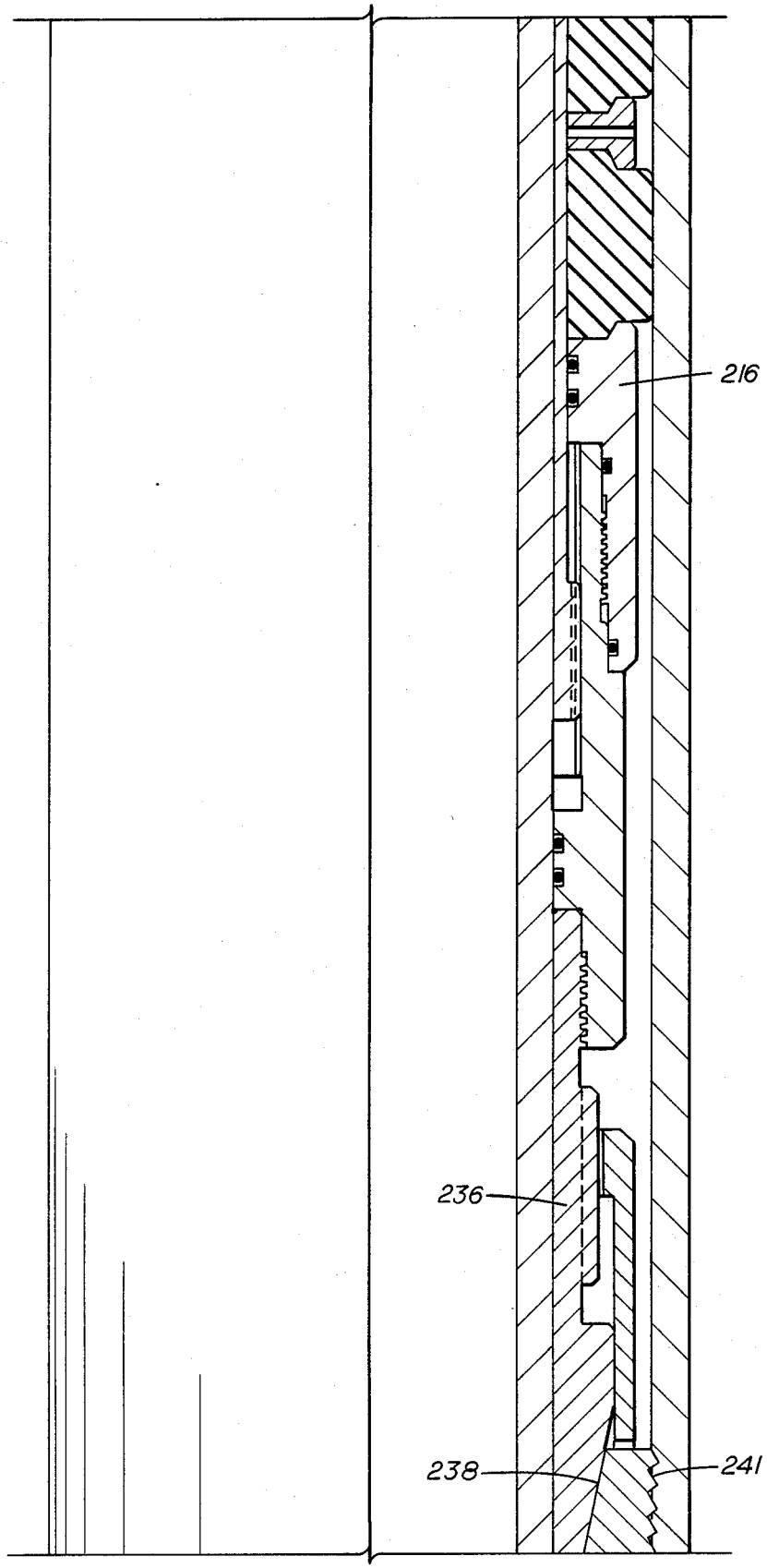
Figure 9:
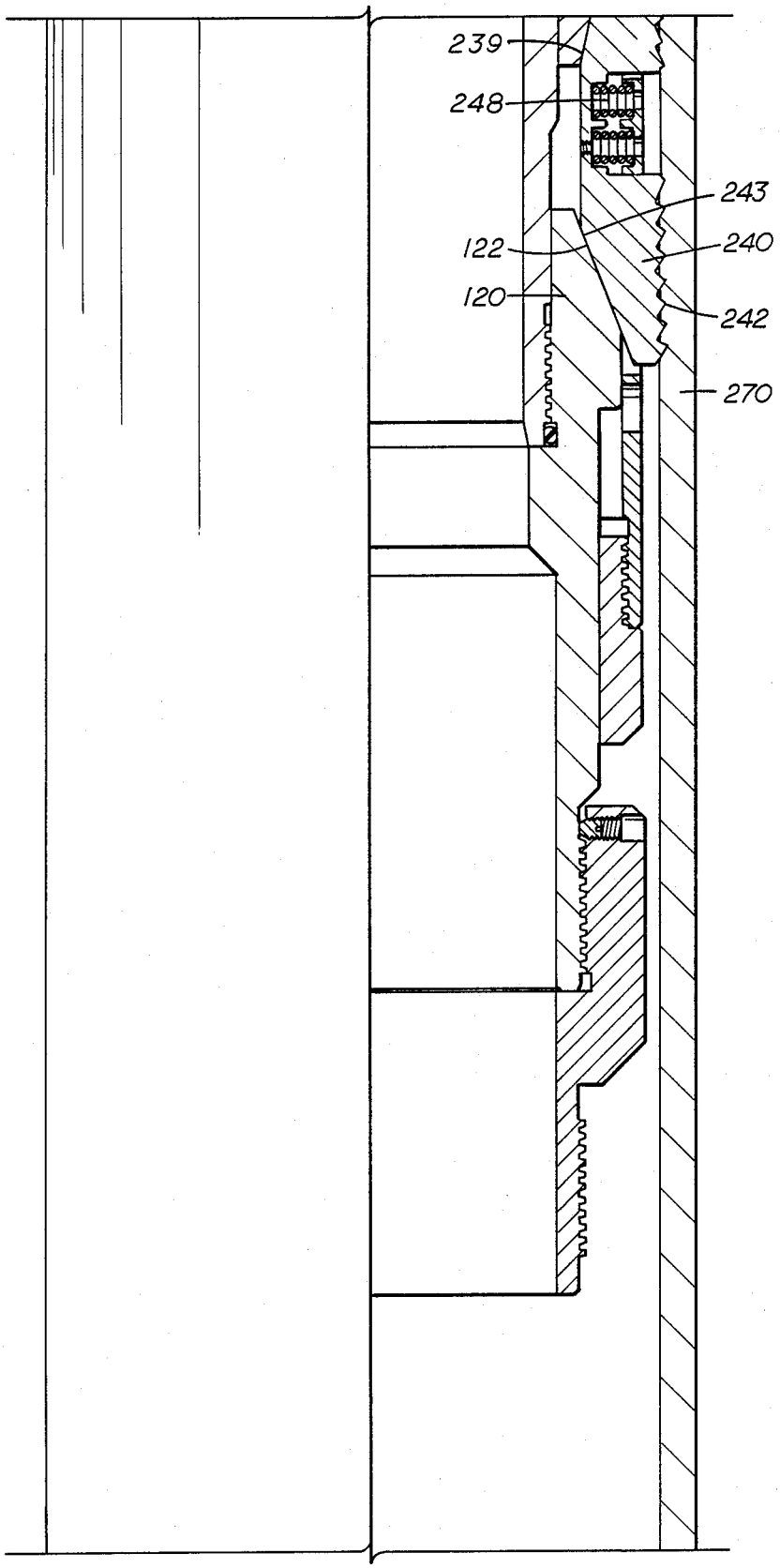

As shown in FIG. 2, an upper sleeve 132 is telescoped over mandrel sleeve 118. Upper sleeve 132 has a gripping or ratchet surface 134 around the upper end of its O.D. and a threaded box end 136 at its lower end. Box end 136 threads to upper pin end 138 of mid-sleeve 140. A lower pin end 142 of mid-sleeve 140 is threaded to the upper box end 139 of a lower sleeve 144. A plurality of radially extending screws 145, which pass through upper box end 139 of sleeve 144 and lower pin end 142 of sleeve 140, aid in attaching mid-sleeve 140 to lower sleeve 144. A plurality of shear pins 143, which pass through mid-sleeve 140 and reside in a recess, groove, or blind bores in the O.D. of mandrel sleeve 118, aid in attaching mid-sleeve 140 to mandrel sleeve 118 in the running-in position.

A shoulder 148 of reduced I.D. is formed in the lower end of mid-sleeve 140 and is disposed inwardly of upper box end 139. An annular space 154 is formed below shoulder 148 and inwardly of lower sleeve 144, between sleeve 144 and inner mandrel 112. A split lock ring 156 is disposed adjacent the lower end of shoulder 148 in space 154. Split lock ring 156 has a ratchet surface 158 around its I.D. which mates with ratchet surface 109 on mandrel 112 when the packer is set. Ring 156 also has a downwardly and inwardly facing frustoconical cam surface 160 around its I.D. at its lower end.

Surface 160 engages a correlatively shaped surface 162 around the upper, outer end surface of a release sleeve 164, surface 162 being an upwardly and outwardly facing frustoconical ramp or cam surface. Release sleeve 164 is disposed in space 154 below ring 156. Release sleeve 164 includes a recess or groove 166 in its outer peripheral surface which accommodates a plurality of radially disposed pins 168 extending through lower sleeve 144.

A seal element actuating ring extension sleeve 170 is located in space 154 radially outwardly of release sleeve 164, and extends below sleeve 164. The upper portion 172 of seal element actuating ring extension sleeve 170 has an I.D. sufficiently large that it receives the O.D. of sleeve 164 therewithin. Upper portion 172 also has a plurality of axially extending slots 174 therein, through which radially extending pins 168 pass prior to entering groove 166 in sleeve 164. Near the mid-portion of extension sleeve 170, on its outer peripheral surface, there is a shoulder 184 which defines the upper end of a recess or groove 186. Groove or recess 186 accommodates a plurality of circumferentially spaced apart shear pins 188 extending radially inwardly from lower sleeve 144.

The lower portion 176 of extension sleeve 170 extends below sleeve 164, and has an I.D. below sleeve 164 substantially the same as the I.D. of sleeve 164. At the upper end of lower portion 176, the I.D. of sleeve 170 includes a downwardly and inwardly facing shoulder 178, which can abut the lower end of release sleeve 164. Lower portion 176 of sleeve 170 has a reduced I.D. and O.D. as compared with upper portion 172. The lower end of lower portion 176 has a pin which is threaded to a box end 180 of seal element actuating ring body 182.

The upper end of extension sleeve 170 includes a radially outwardly extending flange 171, the outer periphery of which slidingly engages the intermediate inside surface 173 of sleeve 144. The lower portion of lower sleeve 144 has a reduced I.D., forming an inwardly extending shoulder 175 around its inner periphery between such lower portion and the intermediate inside surface 173. The I.D. of the lower portion of lower sleeve 144 is substantially the same as the O.D. of extension sleeve 170 below flange 171. Sleeve 144 is permitted to move axially with respect to extension sleeve 170, with pins 168 riding in slots 174, to a limited extent, with an upper limit to such travel being the engagement of pins 168 with the upper ends of slots 174 or the abutment of shoulder 175 against the underside of flange 171; and a lower limit to such travel being the abutment of the lower terminal end of sleeve 144 on the upper terminal end of ring body 182.

The attachment between seal element actuating ring body 182 and extension sleeve 170 is aided by a plurality of set screws 194 which extend through the box end portion of seal element actuating ring body 182 and engage the outer surface of the pin end of lower portion 176. The lower end of actuating ring body 182 has an increased I.D. and a reduced O.D., with a threaded pin on the O.D. and a threaded box on the I.D. The lower pin end of actuating ring body 182 is threaded to upper actuating ring end member 200, and an annular seal 202 is provided at the upper limit of this threaded connection. The lower box end of actuating ring body 182 is threaded to a pin end of an element mandrel 206. An annular seal 208 is provided at the upper end of this threaded connection.

A plurality of annular packer seal elements 210 are bonded to the outer circumferential periphery of element mandrel 206, and are preferably made of an elastomer such as rubber. Mandrel 206 has a splined portion 211 at its lower end, including a plurality of circumferentially spaced apart, longitudinally axially extending splines 209 thereon. Seal elements 210 are preferably spaced apart by annular support members 212. The upper side of the uppermost packer seal element 210 abuts the lower end of upper actuating ring end member 200 and actuating ring body 182.

The lower side of the lowermost packer seal element 210 abuts the upper end of an upper shoe body 216. Upper shoe body 216 has a lower portion 217 of increased I.D., which has internal threads which are threaded to an upper pin end 218 of a lower shoe body 220. The inside surface of the upper portion of upper shoe body 216, which is of reduced I.D. as compared to lower portion 217, slidingly engages the exterior peripheral surface of element mandrel 206 above splines 209. Upper shoe body 216 has a pair of annular grooves 222 on its upper, inner surface, the grooves 222 accommodating annular seals 224 so that upper shoe body 216 is sealed against the outer surface of element mandrel 206. Upper shoe body 216 also has two annular seals 228 around the I.D. of lower portion 217, which seal the threaded connection between lower portion 217 of upper shoe body 216 and upper pin end 218 of lower shoe body 220.

The upper portion of lower shoe body 220 is of increased I.D. as compared to the O.D. of inner mandrel 112 and defines an annular chamber 230, which is large enough in radial extent to accommodate lower splined portion 211 of element mandrel 206 therewithin. Lower splined portion 211 of element mandrel 206 can move axially, but it cannot rotate, in chamber 230. The inner surface of the upper portion of lower shoe body 220 is provided with a plurality of circumferentially spaced apart, longitudinally axially extending splines 231 which antirotationally engage the splines 209 of element mandrel 206. Thus, element mandrel 206 can slide axially with respect to lower shoe body 220, but cannot rotate with respect to it. The mid-portion 213 of lower shoe body 220 below chamber 230 is of reduced I.D. and slidingly engages the outer surface of inner mandrel 112. The upper shoulder 233 of mid-portion 213 defines the lower end of chamber 230. Mid-portion 213 has a pair of annular grooves 232 around its inner surface. Grooves 232 accommodate annular seals 234 which seal between the inner surface of lower shoe body 220 and the outer surface of inner mandrel 112. At the lower end of lower shoe body 220 is a threaded box which attaches to the upper threaded O.D. of an upper slip actuating sub 236.

Upper slip actuating sub 236 has a downwardly and outwardly facing frustoconical cam or ramp surface 238 at its lower end. Surface 238 is engageable with correlatively shaped cam surfaces, which face upwardly and inwardly, on a plurality of slip bodies, e.g., surface 239 on slip body 240. There are a plurality of such slip bodies around the circumference of packer 100. Each slip body has a pair of slip surfaces, for example, surfaces 241, 242 of slip body 240. The slip surfaces have a plurality of teeth on their outer surfaces capable of gripping or biting into a casing wall or a well bore when the slip bodies are actuated as described below. Each slip body also has a downwardly and inwardly facing ramp or cam surface, e.g., surface 243 of slip body 240, on its lower end adapted to engage cam surface 122 of lower slip actuating sub 120. Cam surface 122 faces upwardly and outwardly.

Each slip body has a dual chamber or recess 244 in its mid-portion for receiving a pair of compression springs 248 which bear between the inside surface of a slip cage 246 and the end wall 245 of dual chamber 244. Springs 248 hold slip body 240 in a radially inwardly retracted, deactuated position during running in or retrieval, whereby gripping surfaces 241, 242 are held away from the casing wall or well bore, for example, substantially flush with the outer surface of slip cage 246.

Slip cage 246 is telescoped over upper slip actuating sub 236 and lower slip actuating sub 120. Slip cage 246 is antirotationally, but axially slidably, connected to upper slip actuating sub 236 through engagement of splines 257 on sub 236 with correlatively shaped splines 259 on slip cage 246. Slip cage 246 has a plurality of pairs of windows, such as windows 248, 249, with each pair accommodating a slip body having one pair of gripping surfaces, e.g., upper gripping surface 241 and lower gripping surface 242, so as to allow the gripping surfaces to extend through the windows when the slips are actuated. Slip cage 246 has a lower box end threaded to an upper pin end of cage end sub 250. Cage end sub 250 has a smaller I.D. than slip cage 246, forming a shoulder 251 at the uppermost end of the threaded joint between cage end sub 250 and slip cage 246.

Shoulder 251 is engageable with a radially extending shoulder 253 on the upper outer surface of lower actuating sub 120. The upper end of slip cage 246 also has a radially extending inner shoulder 252, formed below an area 255 of decreased I.D., adapted to engage a shoulder 254 around the outer periphery of upper slip actuating sub 236 above cam surface 238. Upper slip actuating sub 236 and lower slip actuating sub 120 are retained in slip cage 246 by engagement of shoulders 251 and 253, and shoulders 252 and 254. However, slip cage 246, slip bodies 240, and upper slip actuating sub 236 can all move axially to a limited extent with respect to inner mandrel 112. Downward movement of sub 236 into slip cage 246 begins actuation of slips 240, with ramp surface 238 engaging ramp surface 239. Continued downward movement causes ramp surface 122 of lower slip actuating sub 120 to engage ramp surface 243 of slip body 240.

Referring now to FIGS. 6–9, packer 100 is shown in the actuated or set position. Packer 100 is run into the well attached at the upper box end 117 of mandrel sleeve 118 to a hydraulic running and setting tool. When the desired position in the well is reached, downward force is exerted on the upper sleeve 132 with the running and setting tool, with inner mandrel 112 held virtually stationary, thereby moving mid-sleeve 140 downwardly and shearing pins 143. The downward movement of sleeve 132 causes shoulder 148 to push down split lock ring 156, so that its teeth engage the ratchet surface 109 on mandrel 112. Lower sleeve 144, release sleeve 164, extension sleeve 170, seal element actuating ring body 182, ring end member 200, and element mandrel 206 are also moved downwardly. In addition, seal elements 210, upper shoe body 216, lower shoe body 220, and upper slip actuating sub 236 are moved downwardly.

As a result of the downward force exerted on sleeve 132, the slips are set and the packer seal elements 210 are compressed between actuating ring body 182 and upper shoe body 216, forcing the seal elements to move radially outwardly into contact with casing wall 270. When the upper and lower slip actuating subs 236, 120 are forced toward one another in slip cage 246, with lower sub 120 actually remaining virtually stationary, this wedges the slip bodies between the subs 236 and 120, and forces them radially outwardly by the interactions between the mating ramp surfaces 238 and 239, and surfaces 243 and 122, and into contact with casing or well bore wall 270. The slip surfaces, e.g., surfaces 241, 242, bite into the casing wall 270 and hold packer 100 in place. It can be seen that springs 248 are compressed when slips 240 are actuated or set.

Figure 10A:
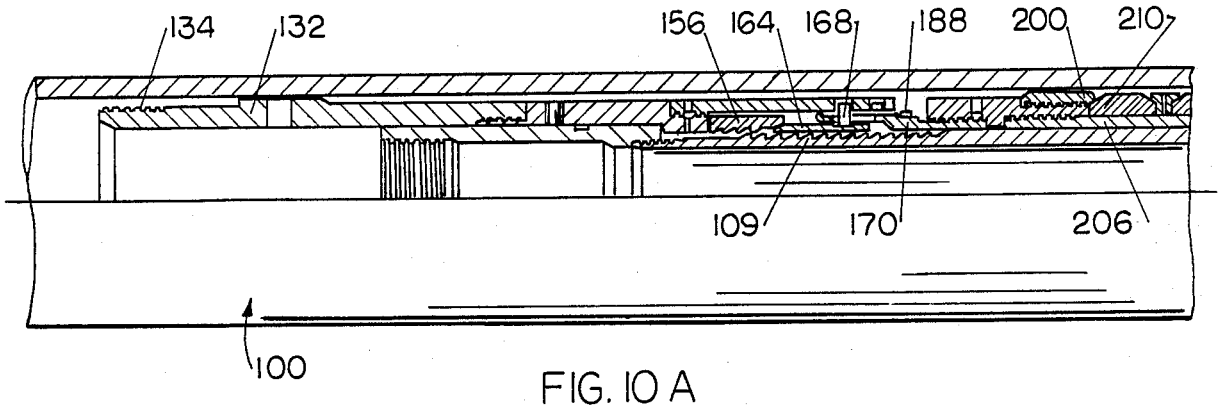
FIGS. 10A and 10B comprise a partially sectional side elevational view of the packer of FIGS. 2–5 in the released position.
Figure 10B:
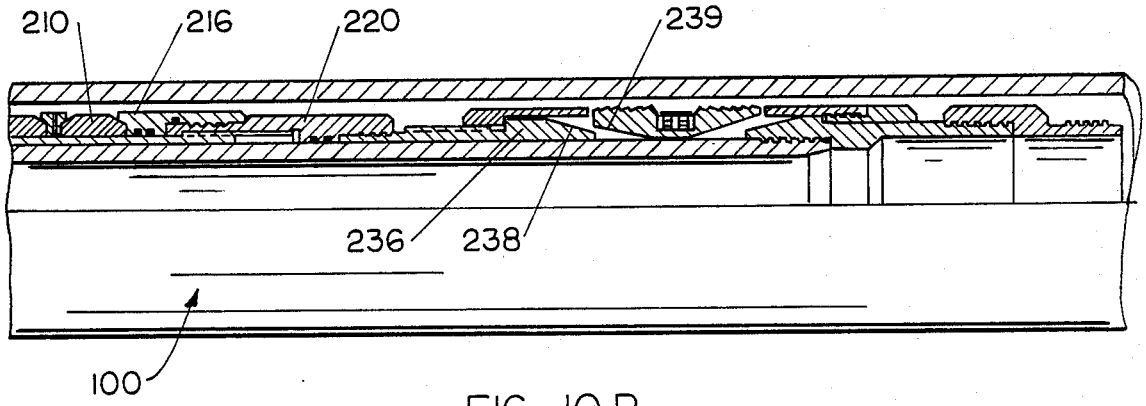
Figure 11:
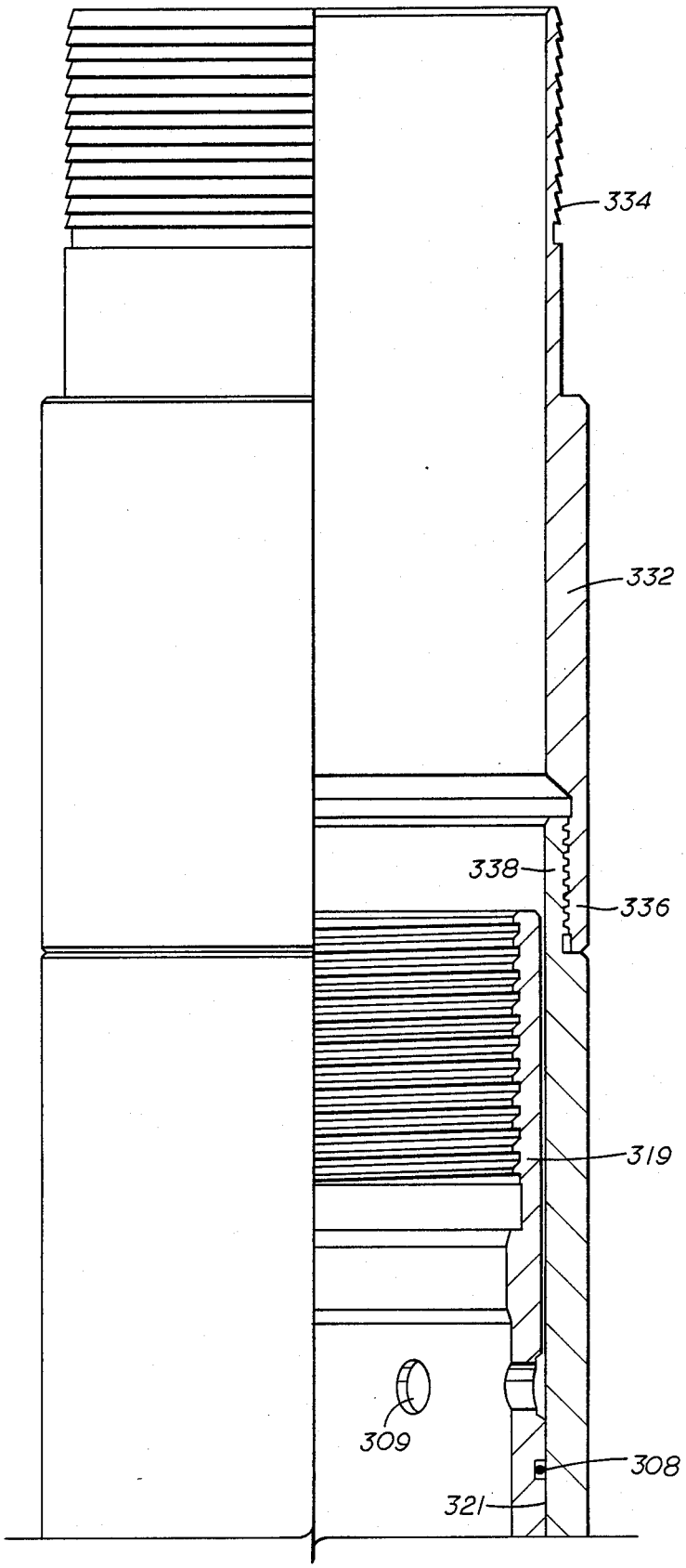
FIGS. 11–14 are partially sectional side elevational views of another embodiment of a releasable packer of the invention, shown in the running in position.
Figure 12:
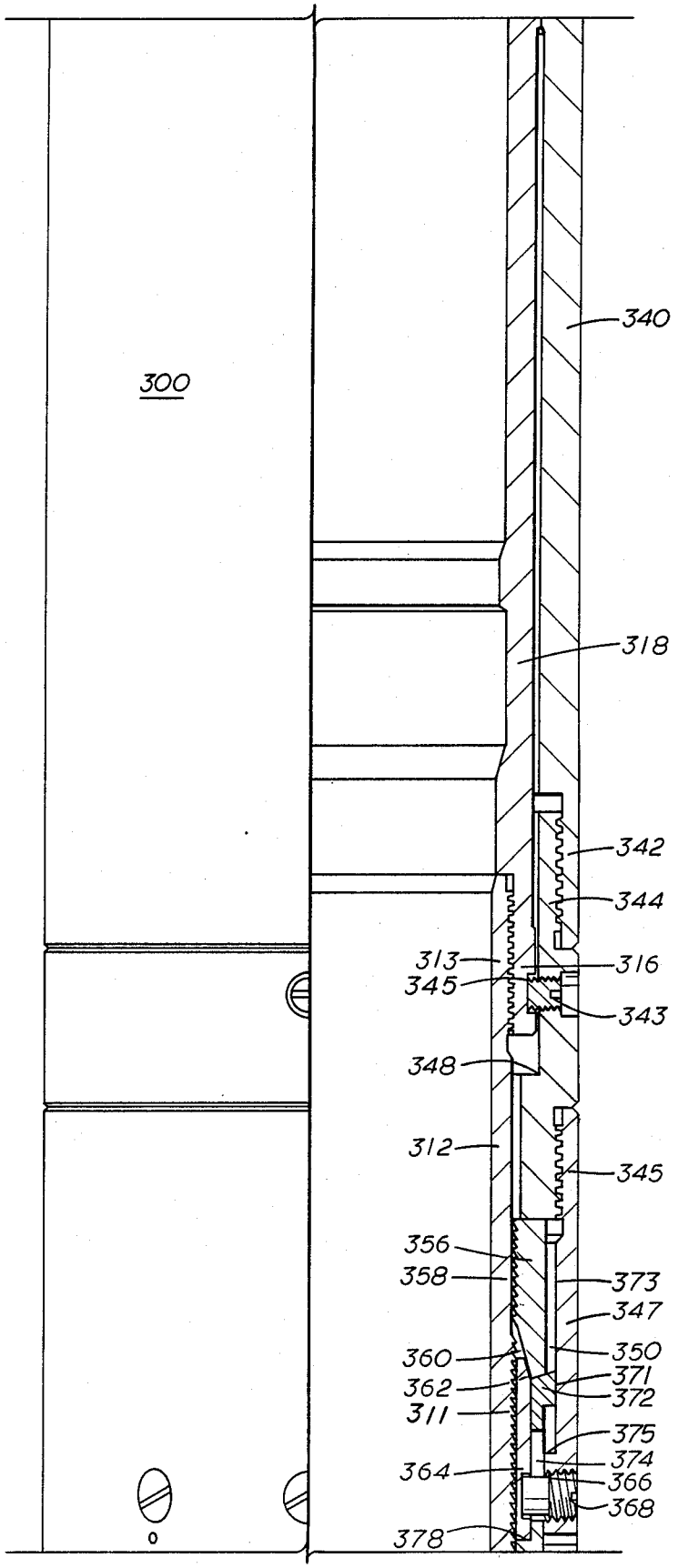
Figure 13:
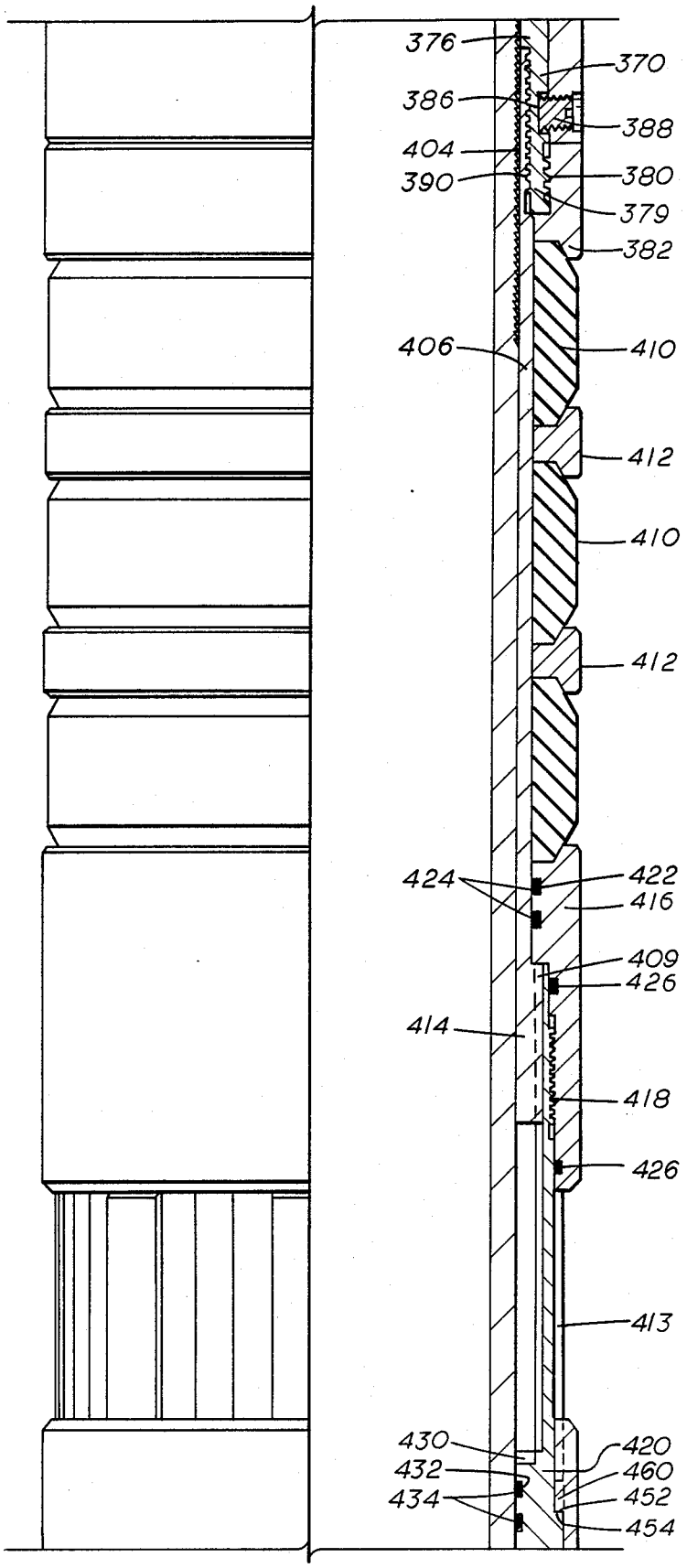
Figure 14:
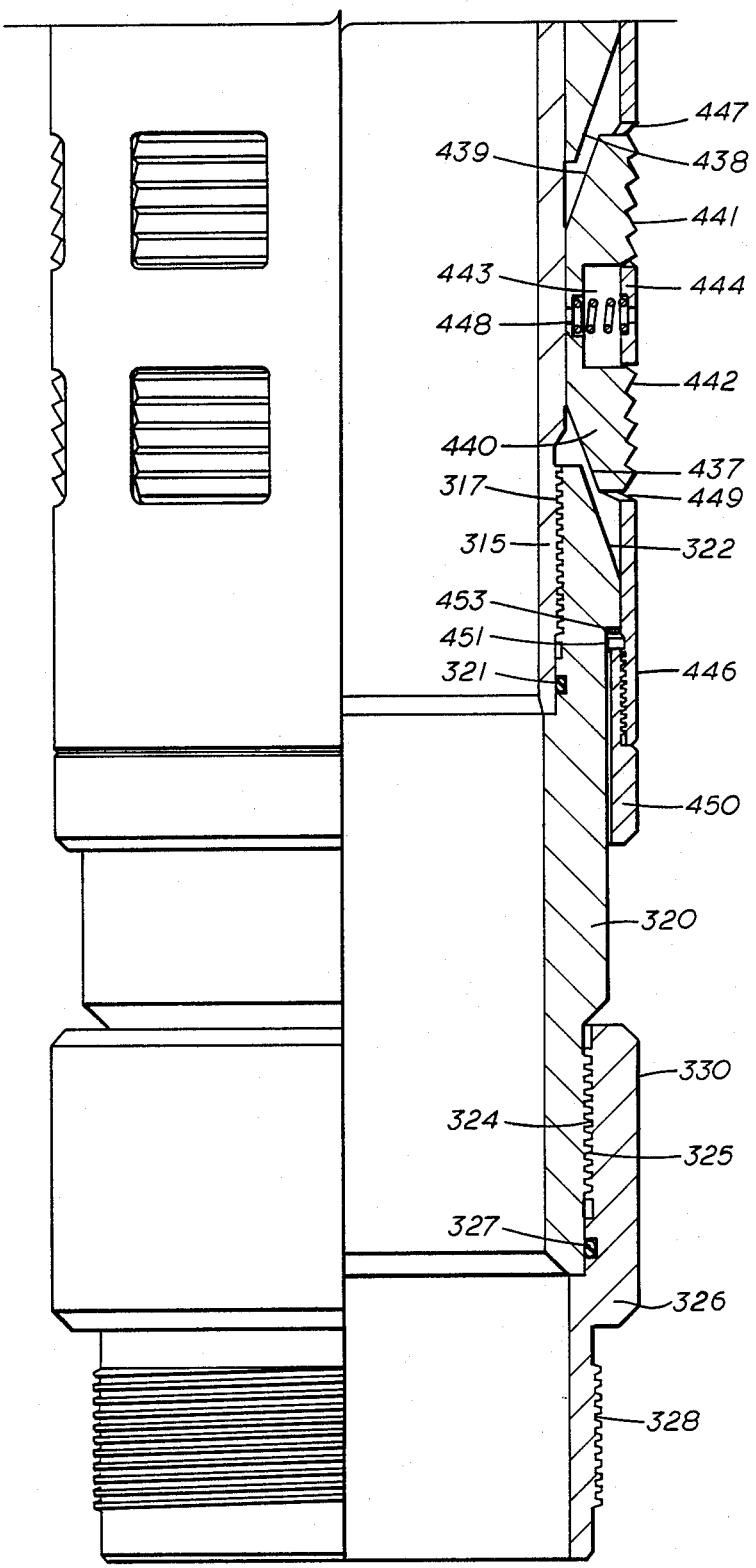
Figure 15:
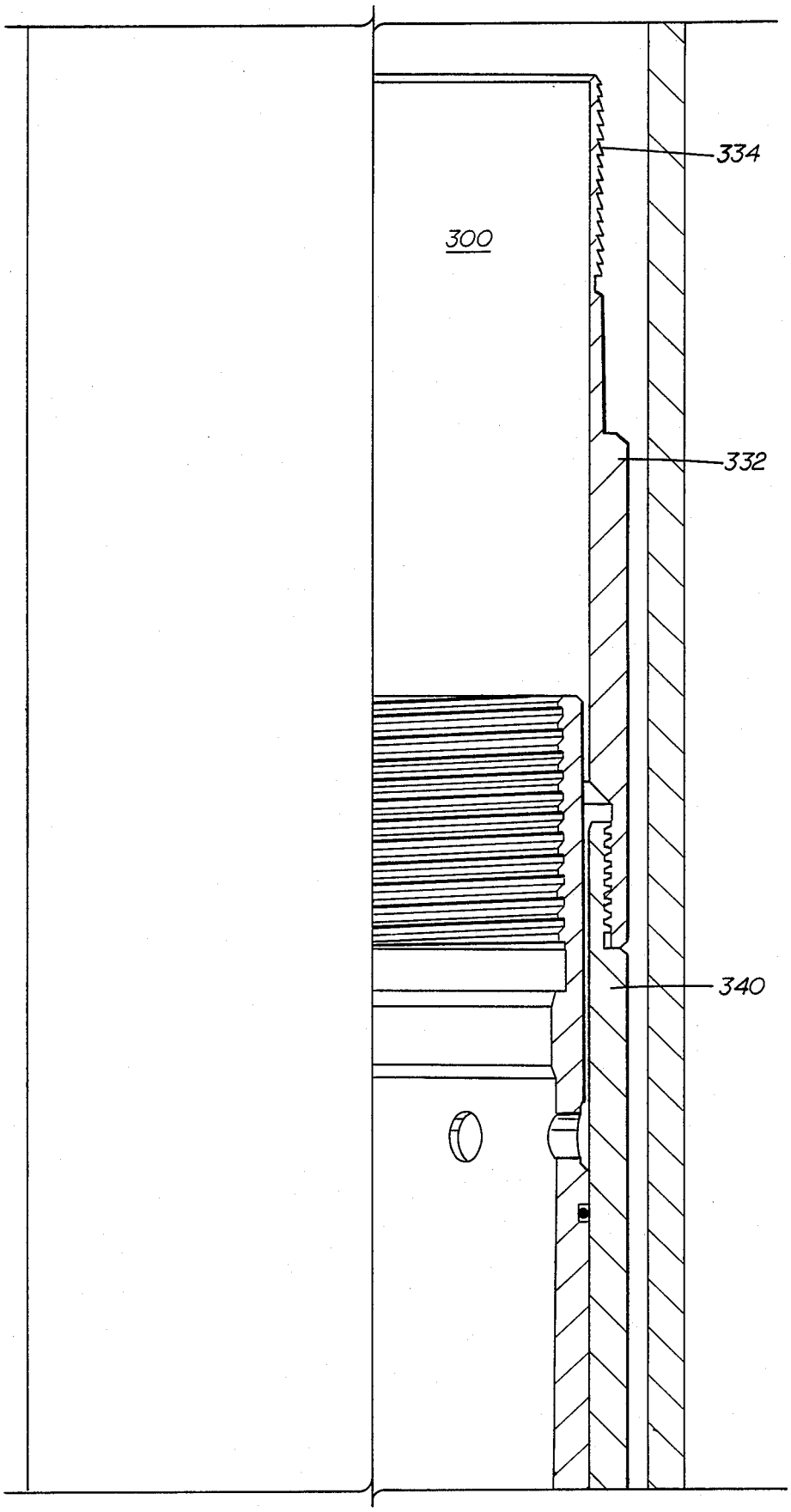
FIGS. 15–18 are partially sectional side elevational views of the releasable packer of FIGS. 11–14 in the actuated position.
Figure 16:
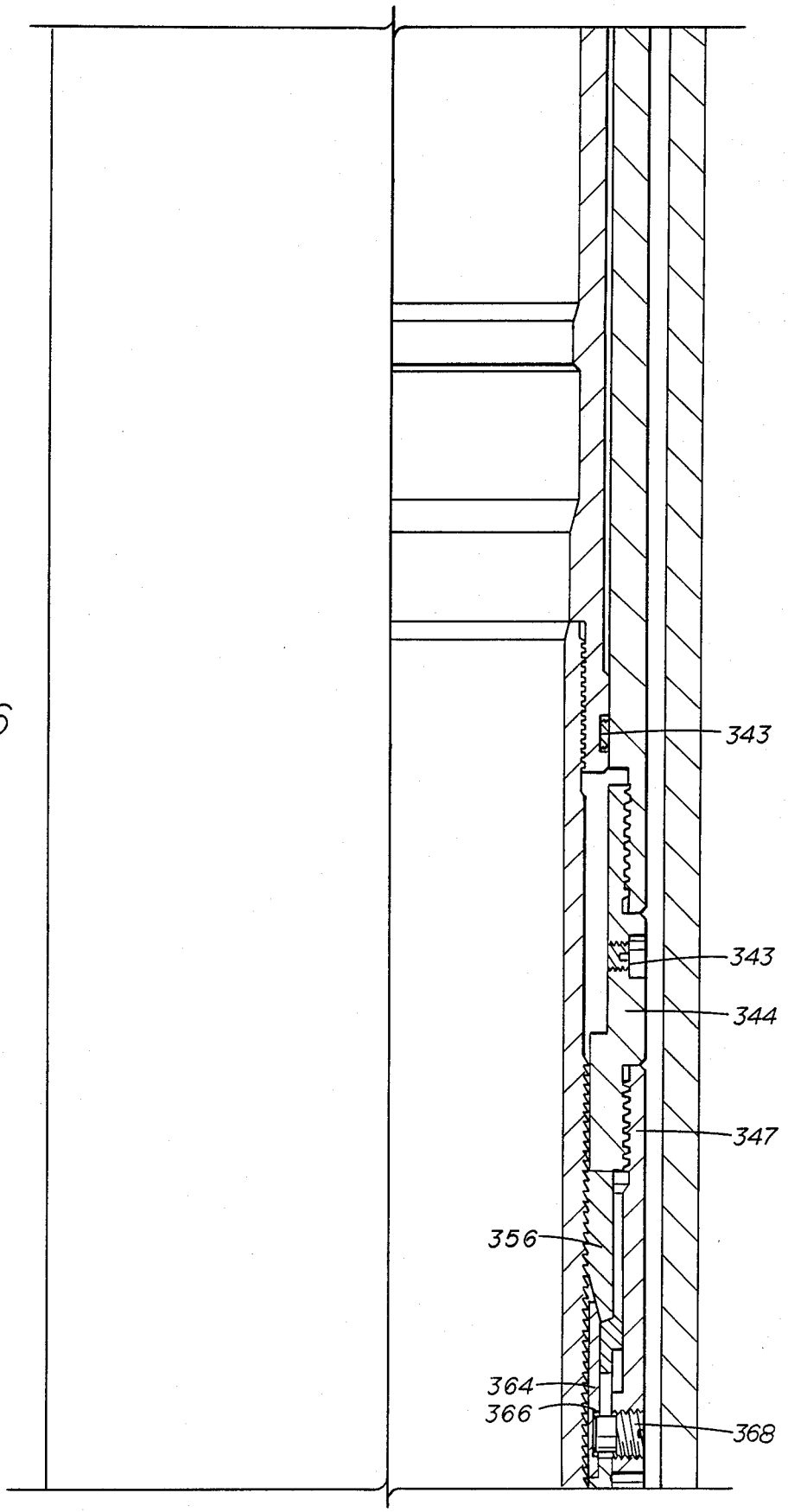
Figure 17:
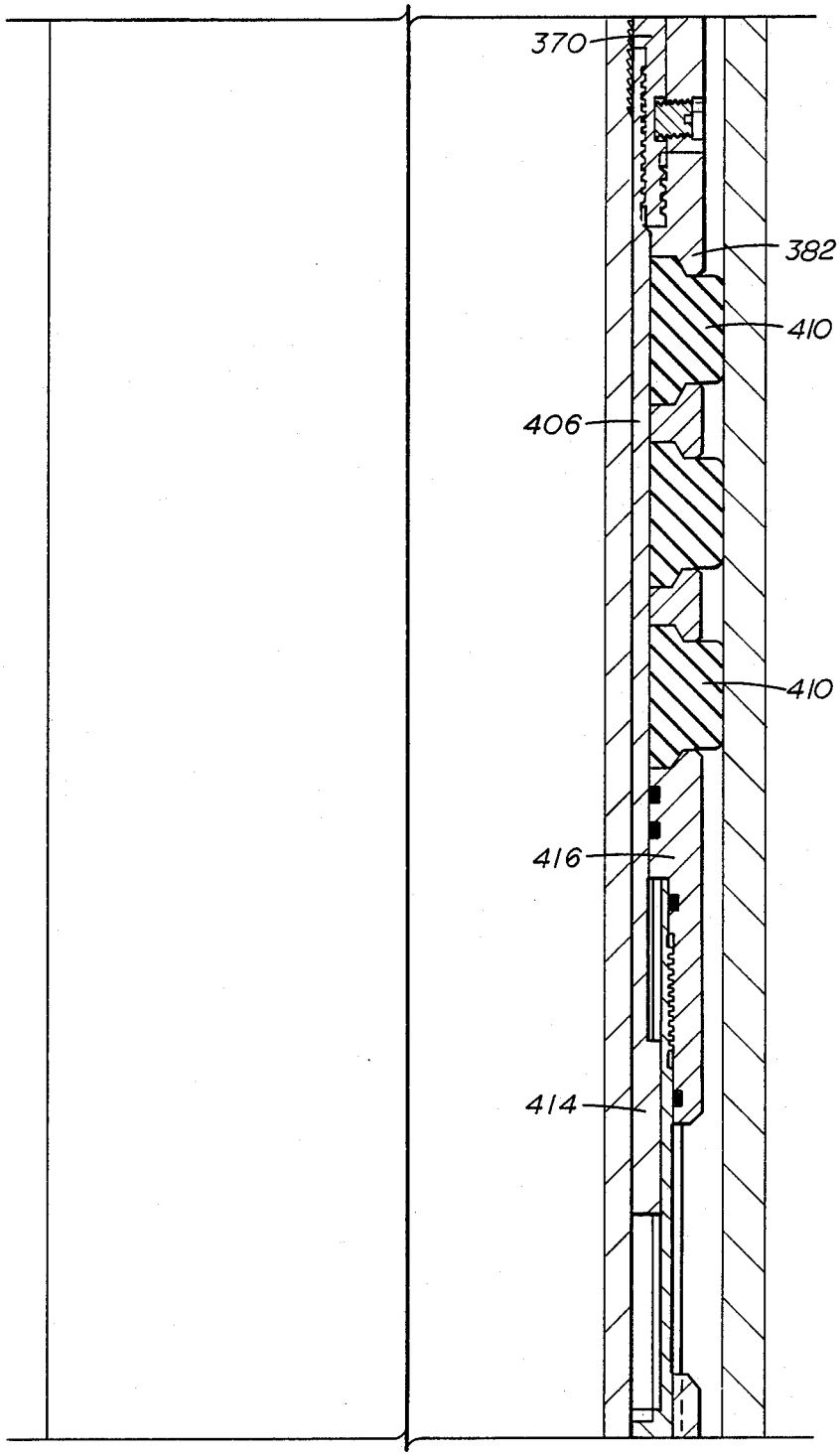
Figure 18:
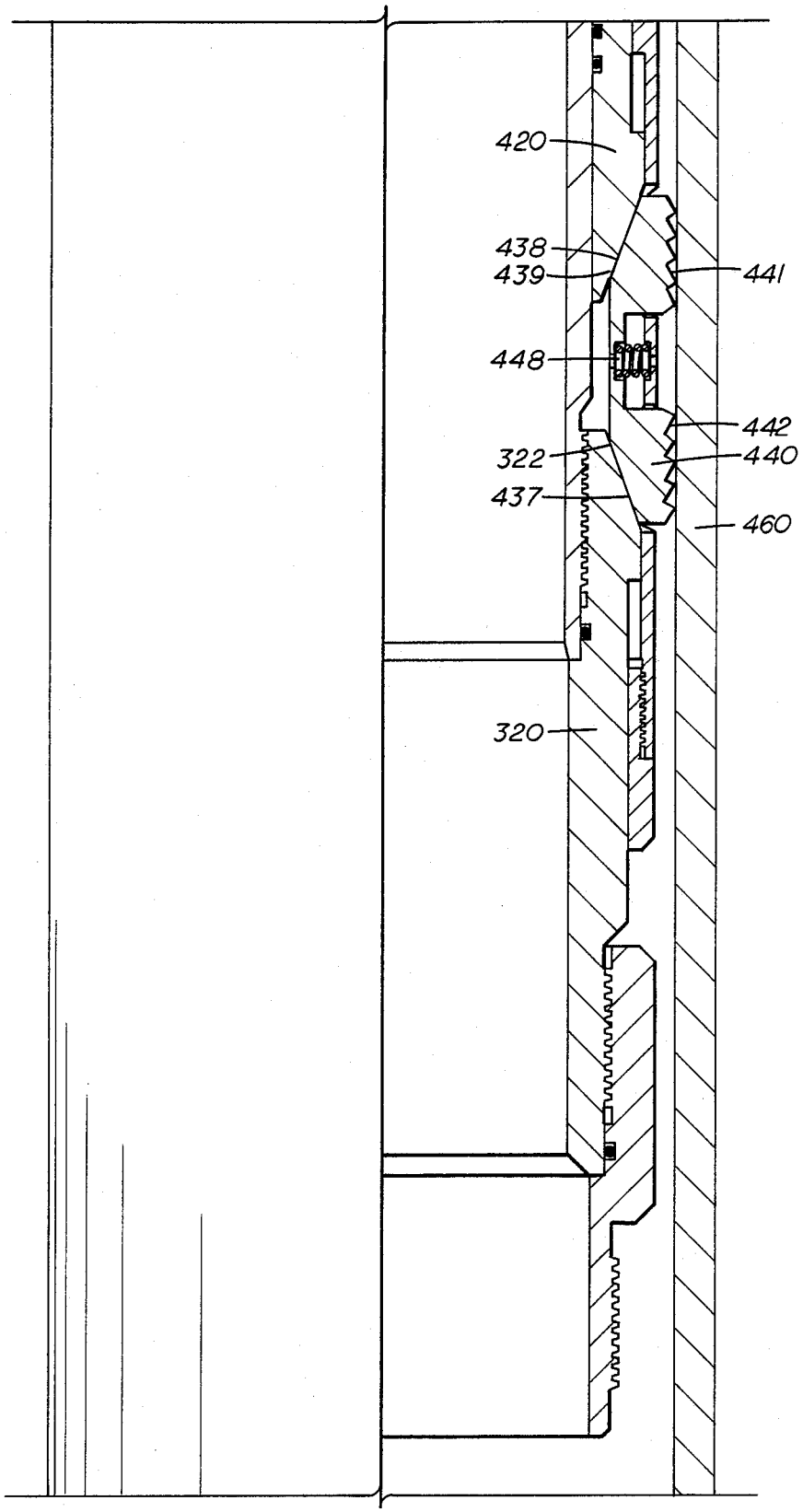

In order to release packer 100, an overshot tool or the like is lowered into the well and over the upper gripping surface 134 of sleeve 132, which is engaged by the overshot tool and pulled upwardly. This shears pins 188, permitting upper sleeve 132, mid-sleeve 140, and lower sleeve 144 to move upwardly. Upward movement of lower sleeve 144 pulls release sleeve 164 upwardly as well, since it is pinned to lower sleeve 144 through pins 168. Pins 168 ride upwardly in slots 174 of extension sleeve 170. Upward movement of release sleeve 164 cams lock ring 156 outwardly due to the engagement of ramp surfaces 160, 162. Thus, split lock ring 156 is moved out of engagement with the ratchet surface 109. The release of ring 156 allows actuating ring body 182, element mandrel 206, upper shoe body 216, lower shoe body 220, and upper slip actuating sub 236 to all be pulled up with sleeve 132. Pins 168 and/or engaged shoulders 171, 175 pull upwardly on extension sleeve 170. Lower portion 211 of element mandrel 206 abuts the radially inwardly extending shoulder on upper shoe body 216 to pull it upwardly. This pulls up lower shoe body 220 and sub 236. As a result of upper slip actuating sub 236 moving up, surface 238 moves away from the correlating surfaces on the slip bodies, e.g., surface 239, thereby releasing the upper slip surfaces. Continued upward movement of sub 236 pulls slip cage 246 and slip bodies 240 away from lower sub 120, fully releasing the slips. Still further upward movement of slip cage 246 effects engagement of shoulders 251, 253 and pulls mandrel 112 upwardly, as well. Thus, packer 100 may be retrieved to the surface. The released position of packer 100 is shown in FIGS. 10A and 10B.

When the packer 100 is in the set position shown in FIGS. 6–9, when fluid pressure is applied from above the packer with the bore of the inner mandrel sealed off, it can be seen that an additional energizing force will be applied to the seal elements 210 equal to the cross-sectional area of inner mandrel 112 multiplied by the applied fluid pressure. This additional force is applied through lock ring 156, extension sleeve 170, and ring body 182. When fluid pressure is applied from below the packer with the bore of the inner mandrel sealed off, an additional energizing force will be applied to the seal elements 210 equal to the cross-sectional area between seals 224 and 234, i.e., the cross-sectional area of element mandrel 206, multiplied by the applied fluid pressure. This additional force is applied through upper shoe body 216. Accordingly, there will be an additional energizing force applied to seal elements 210 no matter whether fluid pressure is applied from above or below packer 100. Packer 100 is thus self-energized from application of fluid pressure from either axial direction.

FIGS. 11–14 show another embodiment of a releasable packer 300 of the invention in the running in or deactuated position. Packer 300 includes an elongated tubular inner mandrel 312 with upper and lower pin ends 313, 315, respectively. Mandrel 312 has a ratchet surface 311 around an upper portion of its O.D. Packer 300 has a plurality of holes 309 through its side wall and into its inner bore near its upper end for access by a cross-over tool (not shown). Upper pin end 313 is threaded to a lower box end 316 of a mandrel sleeve 318. Mandrel sleeve 318 has an upper threaded box end 319. An upper mid-portion 321 of sleeve 318 has a slightly increased O.D. A seal 308 located on the outer surface of upper mid-portion 321 seals between sleeve 318 and a mid-sleeve 340. Lower pin end 315 is threaded to a box end 317 of a lower slip actuating sub 320. A seal 321 is positioned below this threaded joint to seal between sub 320 and mandrel 312. Sub 320 has an upwardly and outwardly facing frustoconical ramp or cam surface 322 around its upper end.

A pin 324 at the lower end of sub 320 is threaded to a box end 325 on a sub body 326. A seal 327 is located below the joint between pin end 324 and box end 325. Sub body 326 forms the lower end of packer 300 and has a lower pin end 328 of reduced O.D. and an upper portion 330.

An upper sleeve 332 is threaded to a mid-sleeve 340, which is telescoped over the upper end of mandrel sleeve 318. Upper sleeve 332 has a ratchet surface 334 around the upper end of its O.D. and a box 336 at its lower end. Box end 336 threads to upper pin end 338 of mid-sleeve 340. A lower box end 342 of mid-sleeve 340 is threaded to the upper pin end of a lower sleeve 344. A plurality of shear pins 343 pass through radially extending bores in lower sleeve 344 and rest in a recess, groove, or blind bores 345 on the outer surface of mandrel sleeve 318, to aid in attaching lower sleeve 344 to mandrel sleeve 318 in the running-in position.

Lower sleeve 344 has a lower portion of reduced O.D. and reduced I.D., the reduced I.D. portion extending axially farther from the lower terminal end of sleeve 344 than the reduced O.D. portion. Shoulder 348 is formed on the I.D. between the lower portion and an increased I.D. portion above it. An upper box end 345 of an outer actuating sleeve 347 is threaded to a lower pin end of lower sleeve 344. Actuating sleeve 347 has an O.D. substantially the same as that of lower sleeve 344, but an I.D. larger than that of sleeve 344. An annular space 350 is formed below the lower terminal end of lower sleeve 344 and inwardly of actuating sleeve 347, between sleeve 347 and mandrel 312. A split lock ring 356 is disposed adjacent the lower end of sleeve 344 in space 350. Split lock ring 356 has a ratchet surface 358 around its I.D. which lockingly engages ratchet surface 311 on the outer surface of mandrel 312 when the packer is set. Ring 356 also has a downwardly and inwardly facing frustoconical cam surface 360 around the I.D. of its lower end.

Surface 360 engages a correlatively shaped surface 362 on a release sleeve 364, surface 362 being an upwardly and outwardly facing frustoconical ramp or cam surface. Sleeve 364 is situated in space 350 in the area below lock ring 356. Sleeve 364 includes a recess or groove 366 in its outer periphery which accommodates a plurality of radially disposed pins 368. Pins 368 extend through threaded bores in actuating sleeve 347.

An upper portion 372 of a seal element actuating ring extension sleeve 370 is disposed outwardly of release sleeve 364 in space 350. The upper portion 372 of extension sleeve 370 has an I.D. large enough to telescope over sleeve 364. Upper portion 372 also has a plurality of axially extending slots 374 therethrough. Pins 368 pass through slots 374 and can ride axially in the slots. A lower portion 376 of extension sleeve 370 is of reduced I.D. below sleeve 364. A groove, recess, or blind bore 386 is located on the outer surface of lower portion 376. Groove or recess 386 accommodates a plurality of circumferentially spaced apart shear pins 388, which extend through actuating sleeve 347 and into groove 386. At the upper end of the lower portion 376 there is a shoulder 378 on the I.D. of extension sleeve 370. Shoulder 378 abuts the lower end of release sleeve 364.

The lower portion 376 of extension sleeve 370 is threaded at pin end 379 to a box end 380 of a seal element actuating ring body 382. A box 390 on the lower end of extension sleeve portion 376 is threaded to an upper pin end 404 of an element mandrel 406.

The upper end of extension sleeve 370 includes a radially outwardly extending flange 371, the outer periphery of which slidingly engages the intermediate inside surface 373 of sleeve 347. The lower portion of sleeve 347 has a reduced I.D., forming an inwardly extending shoulder 375 around its inner periphery between such lower portion and surface 373. The I.D. of the lower portion of sleeve 347 is substantially the same as the O.D. of sleeve 370 below flange 371. Sleeve 347 is permitted to move axially with respect to extension sleeve 370, with pins 368 riding in slots 374, to a limited extent. Pins 368 may not travel upwardly or downwardly beyond the upper and lower ends of slots 374, and sleeve 347 may not travel upwardly beyond engagement of shoulder 375 against flange 371 nor downwardly beyond abutment of its lower terminal end on the upper terminal end of actuating ring body 382.

The lower end of ring body 382 abuts the uppermost side of a plurality of annular packer seal elements 410. Packer seal elements 410 are bonded to the outer side of element mandrel 406, and are preferably made of an elastomer, such as natural or synthetic rubber. Elements 410 are spaced apart and supported by annular support members 412. Element mandrel 406 has a splined portion 414 at its lower end, including a plurality of circumferentially spaced apart, longitudinally axially extending splines 409 thereon.

The lower side of the lowermost packer seal element 410 abuts the upper end of an upper shoe body 416. Upper shoe body 416 has an upper portion of smaller I.D. than the lower portion thereof. The lower portion has a threaded box on its I.D. near the lower end which is threaded to a pin end 418 of an upper slip actuating sub 420.

The I.D. of the upper portion of shoe body 416 engages the O.D. of element mandrel 406 immediately above the lower splined portion 414. The upper portion of shoe body 416 has a pair of annular grooves 422 around its inner surface. The grooves 422 accommodate annular seals 424 so that shoe body 416 is sealed against element mandrel 406. Shoe body 416 also has a pair of seals 426 on the I.D. of its lower portion, which seal the threaded connection between shoe body 416 and upper slip actuating sub 420.

Upper slip actuating sub 420 has an upper portion of increased I.D. which defines an annular space 430 with respect to inner mandrel 312. Annular space 430 is large enough to accommodate the lower portion 414 of element mandrel 406. Sub 420 has a plurality of splines 411 on its I.D. which engage splines 409 of element mandrel 406. Lower splined portion 414 of element mandrel 406 can move axially within space 430. Thus, element mandrel 406 can telescope within sub 420, but it cannot rotate therein.

The lower portion of sub 420 is of reduced I.D. and defines the lower end of annular space 430. The I.D. of the lower portion of sub 420 engages inner mandrel 312, and has a pair of annular grooves 432 around its inner surface. Grooves 432 accommodate annular seals 434 which seal between the I.D. of sub 420 and the O.D. of inner mandrel 312. At the lower end of sub 420 a downwardly and outwardly facing frustoconical cam or ramp surface 438 is provided.

Upper slip actuating sub 420 also has a plurality of longitudinally axially extending splines 413 on its I.D. below shoe body 416.

Surface 438 is engageable with correlatively shaped cam surfaces on a plurality of slip bodies, e.g., upwardly and inwardly facing surface 439 on slip body 440. There are a plurality of such slip bodies around the circumference of packer 300. Each slip body has a pair of slip surfaces, for example, surfaces 441, 442 of slip body 440. The slip surfaces have a plurality of teeth on their outer surfaces capable of gripping or biting into a casing wall or a well bore when the slip bodies are actuated as described below. Each slip body also has a downwardly and inwardly facing ramp or cam surface 437 on its lower end adapted to engage cam surface 322 of actuating sub 320. Cam surface 322 faces outwardly and upwardly.

Each slip body has a recess or chamber 443 in its mid-portion for receiving a compression spring 448 which bears against the inner wall of chamber 443 and an I.D. surface 444 of a slip cage 446. Springs 448 hold slip bodies 440 in a retracted, deactuated position when running in or retrieving packer 300 such that slip surfaces 441, 442 are held away from the casing wall or well bore, for example, substantially flush with the outer surface of slip cage 446.

Slip cage 446 is telescoped over upper slip actuating sub 420 and lower slip actuating sub 320. Slip cage 446 is antirotationally, but axially slidably, connected to upper sub 420 through engagement of splines 413 on sub 420 with correlatively shaped splines 460 on slip cage 446. Slip cage 446 has a plurality of pairs of windows, for example, windows 447, 449, with each pair accommodating a slip body having one pair of gripping surfaces so as to allow the gripping surfaces to extend therethrough. Slip cage 446 has a lower box end threaded to a pin end of cage end sub 450. Cage end sub 450 has a shoulder 451 at its upper terminal end.

The upper end of slip cage 446 has a shoulder 452 on its I.D. for engagement with a shoulder 454 on the O.D. of upper slip actuating sub 420. Shoulder 451 on cage end sub 450 is similarly engageable with a shoulder 453 on the O.D. of lower actuating sub 320. Upper sub 420 and lower sub 320 are retained in slip cage 446 by shoulders 451 and 453, and shoulders 454 and 452. However, slip cage 446, slip bodies 440, and upper slip actuating sub 420 can all move axially to a limited extent with respect to mandrel 312. Slips 440 are set in the same way as slips 240 described in connection with the first embodiment of the invention.

Referring to FIGS. 15–18, packer 300 is shown in the actuated or set position. Actuation of packer 300 is effected in substantially the same way as packer 100. Upper sleeve 332 is forced downwardly under the urging of, for example, a hydraulic running and setting tool. Pins 343 are sheared by this movement, and upper sleeve 332 carries down mid-sleeve 340, lower sleeve 344, and actuating sleeve 347. The lower end of lower sleeve 344 pushes down split lock ring 356, so that it lockingly engages ratchet surface 311. Release sleeve 364, extension sleeve 370, actuating ring body 382 and element mandrel 406 are also forced downwardly. In addition, seal elements 410, upper shoe body 416, and upper slip actuating sub 420 are moved downwardly.

Packer seal elements 410 are compressed between ring body 382 and upper shoe body 416, energizing the seals. Upper and lower slip actuating subs 420, 320 are forced toward one another in slip cage 446, wedging slip bodies 440 into gripping contact with the casing or well bore. The slip bodies are pushed outwardly by the interaction between the correlating ramp surfaces 439, 437 on the slip bodies, and the surfaces 438, 322 on the upper sub 420 and lower sub 320, respectively. Springs 448 are compressed when the slip bodies are actuated.

Still referring to FIGS. 15–18, it can be seen that in the set or actuated position, if fluid pressure is applied from above packer 300 with the bore of the inner mandrel sealed off, an additional energizing force will be applied to the seal elements acting down on inner mandrel 312 and through lock ring 356 and extension sleeve 370, such force being equal to the cross-sectional area of inner mandrel 312 multiplied by the applied fluid pressure. Thus, this additional energizing force acts to further compress, and thereby further energize, packer seal elements 410. When fluid pressure is applied from below the packer with the inner mandrel sealed off, an additional energizing force will be applied to the seal elements 410 equal to the cross-sectional area between seals 434, 424, i.e., the cross-sectional area of element mandrel 406, multiplied by the applied fluid pressure. This additional force is applied through upper shoe body 416. Accordingly, there will be an additional energizing force applied to seal elements 410 no matter whether pressure is applied from above or below packer 300.

Referring to packer 100, shown in the actuated position in FIGS. 6–9, it can be seen that fluid pressure applied from above or below will have the same additional energizing effect as it does on packer 300.

Figure 19A:
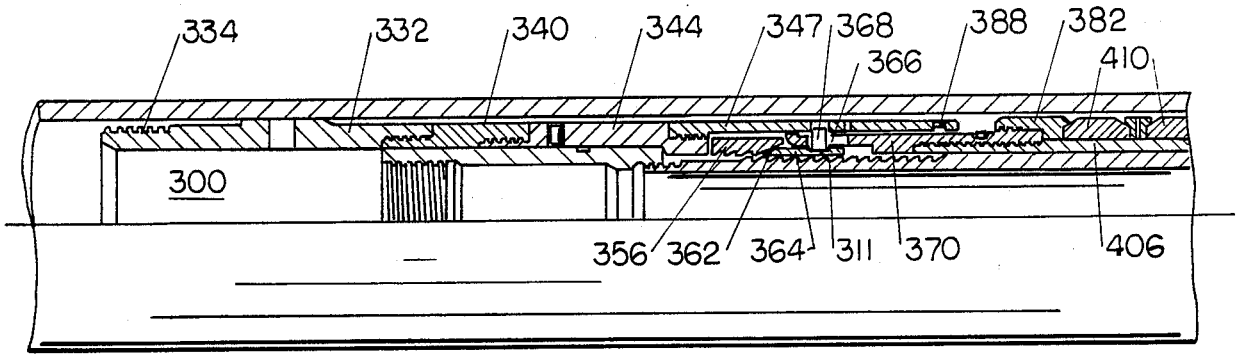
FIGS. 19A and 19B comprise a partially sectional side elevational view of the releasable packer of FIGS. 11–14 in the released position.
Figure 19B:
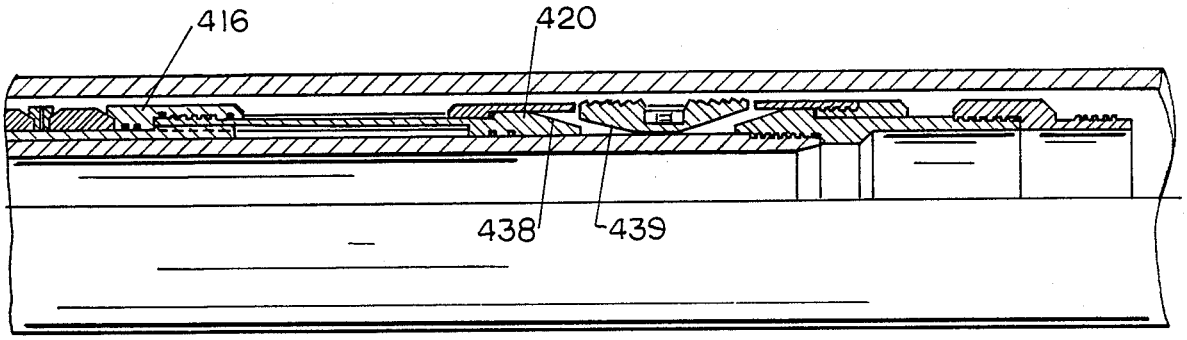

In order to release packer 300, an overshot tool or the like is lowered into the well and over the upper gripping surface 334 of sleeve 332, which is engaged by teeth on the overshot tool and pulled upwardly. This pulls up upper sleeve 332, which in turn pulls up mid-sleeve 340, lower sleeve 344, and actuating sleeve 347. The movement of actuating sleeve 347 causes the shearing of pins 388. This also pulls up release sleeve 364. Release sleeve 364 cams lock ring 356 out of engagement with mandrel 312. This releases the seal element lockdown mechanism. Further upward movement of sleeve 347 eventually pulls up extension sleeve 370, which in turn pulls up element mandrel 406, packing elements 410, shoe 416, and upper slip actuating sub 420, releasing the upper wedge support for the slips. Further upward movement then pulls the slip cage away from lower sub 320, fully releasing the slips. Then cage 446 engages and pulls up on inner mandrel 312. The released position of packer 300 is shown in FIGS. 19A and 19B.

Figure 20:
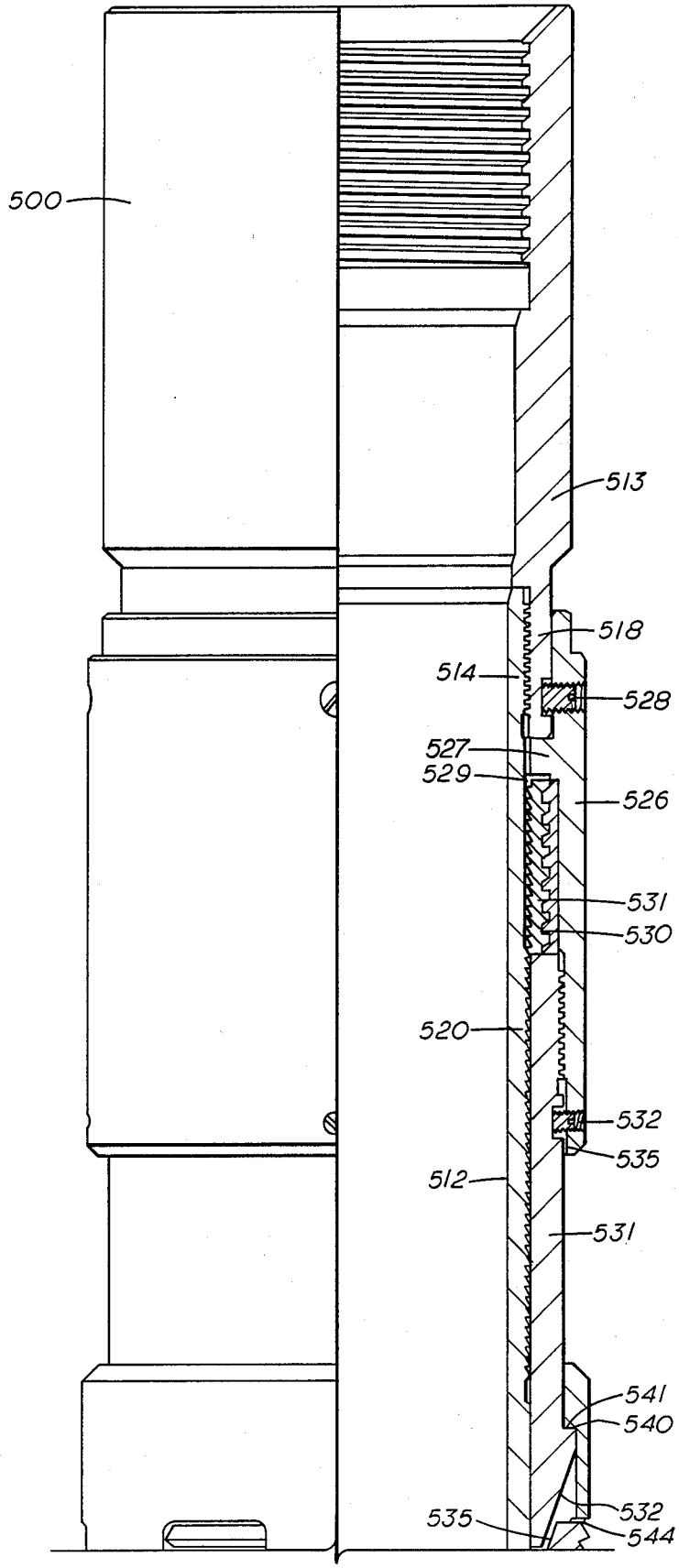
FIGS. 20–21 are partially sectional side elevational views of one embodiment of sump packer of the invention in the running in position.
Figure 21:
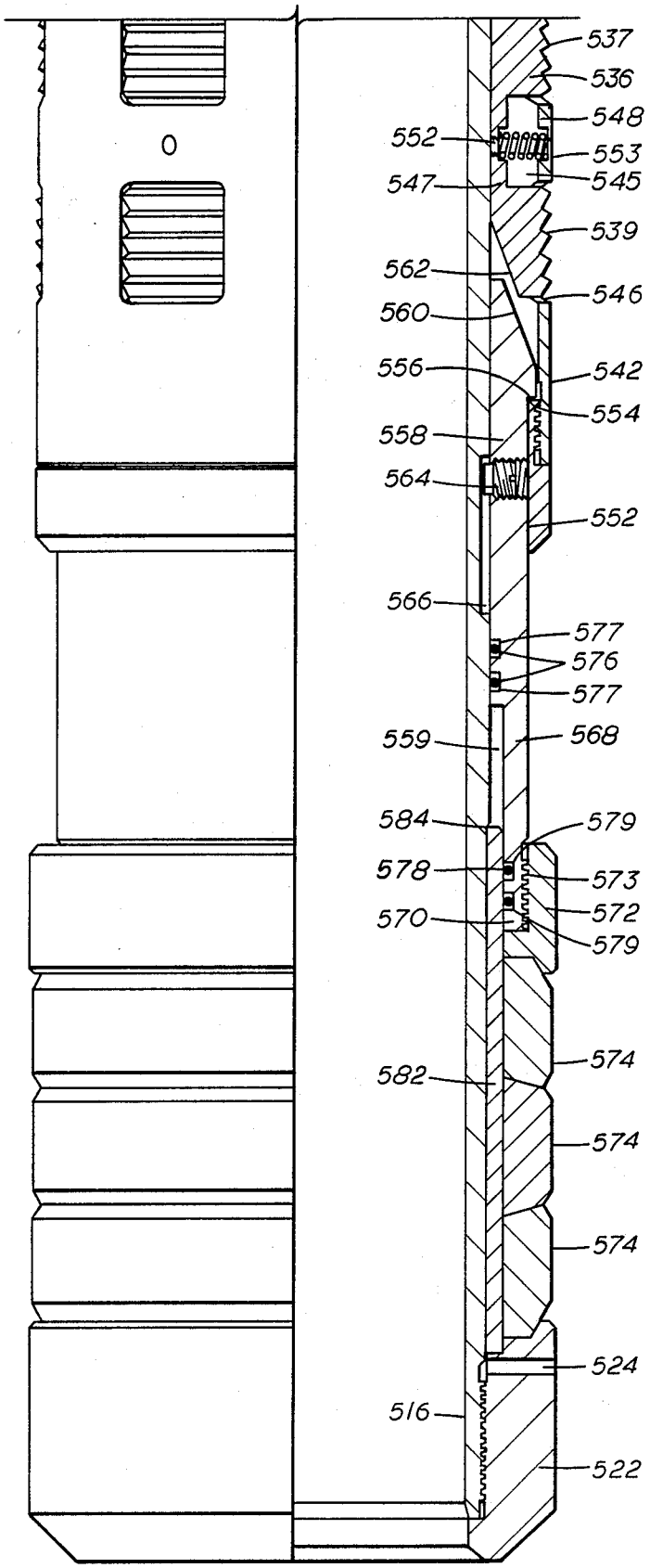
Figure 22:
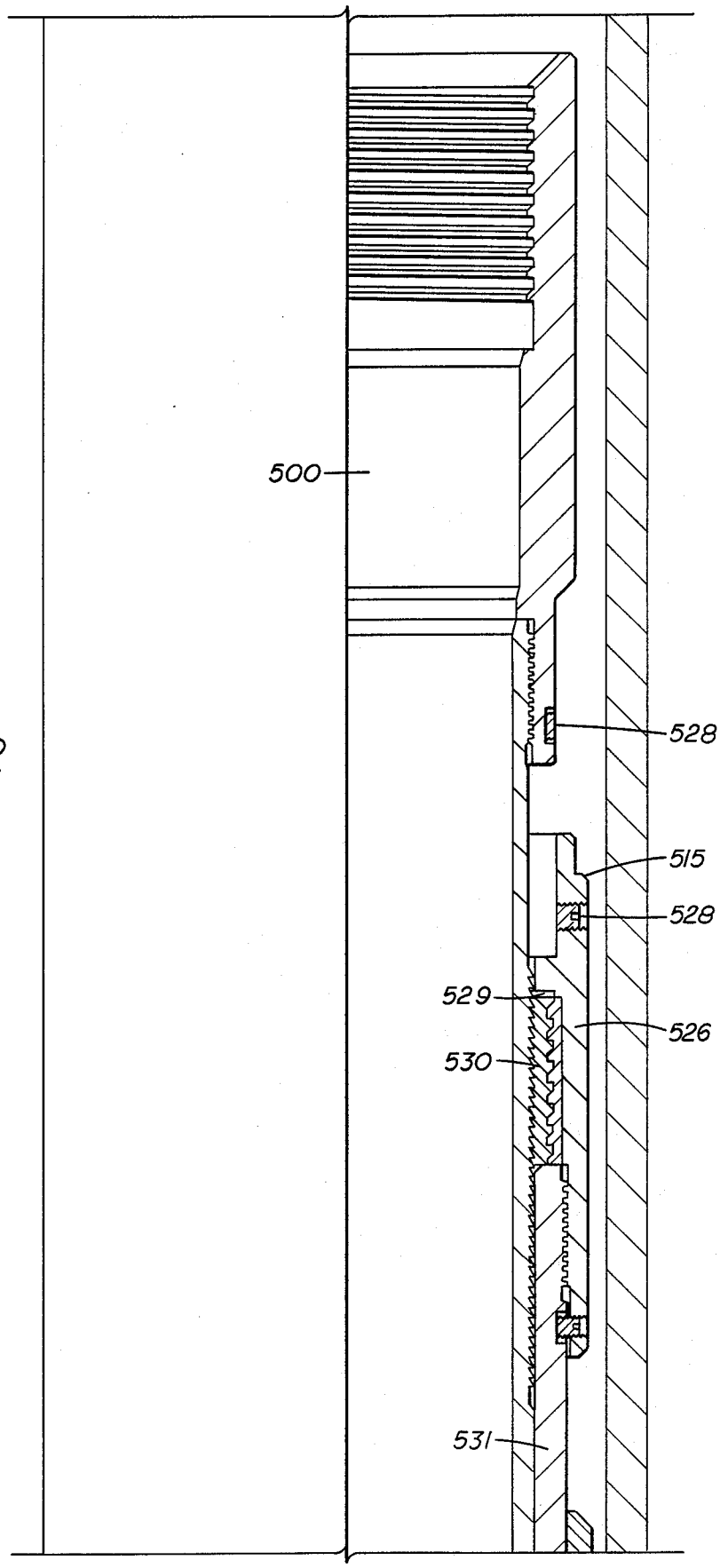
FIGS. 22–23 show the sump packer of FIGS. 20–21 in the actuated position.
Figure 23:
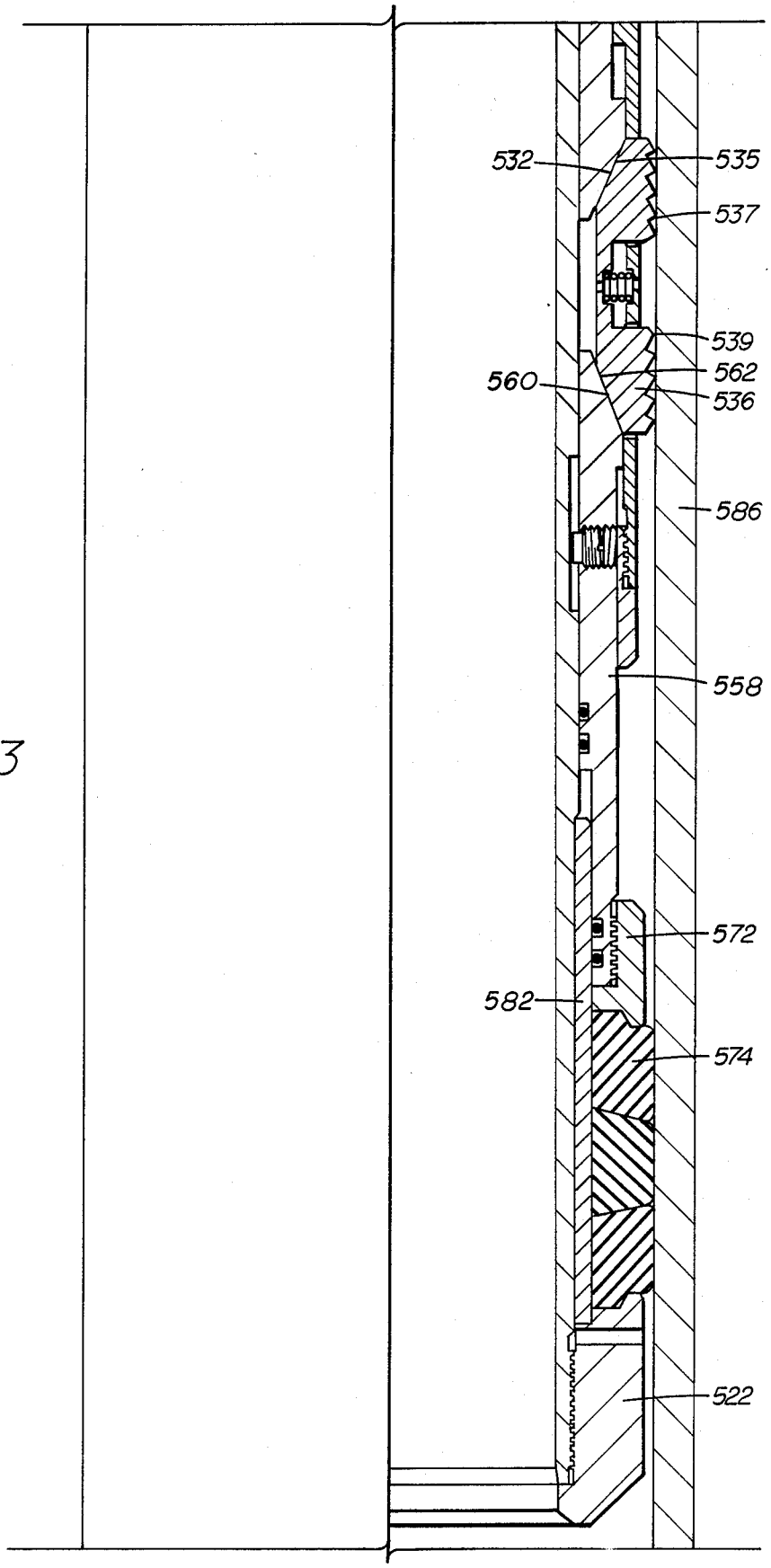

FIGS. 20–21 illustrate a sump packer 500 of the invention in the running in position, and FIGS. 22–23 show packer 500 in the set or actuated position. Referring to FIGS. 20–21, sump packer 500 has an elongated tubular inner mandrel 512 with externally threaded upper and lower pin ends 514 and 516, respectively. Pin end 514 threads to an internally threaded box end 518 on a sleeve 513 having an O.D. larger than that of inner mandrel 512.

Inner mandrel 512 has a ratchet surface 520 around a portion of its external surface below pin end 514. Lower pin end 516 of inner mandrel 512 is threaded to an end sub 522. The lower end of sub 522 forms the bottom of packer 500. End sub 522 has a radial bore 524 extending therethrough from the upper portion of the threaded connection between end sub 522 and inner mandrel 512.

An outer sleeve 526 is telescoped over the lower portion of sleeve 513, and extends axially along a portion of inner mandrel 512. A plurality of circumferentially spaced apart shear pins 528 secure outer sleeve 526 to sleeve 513. Outer sleeve 526 has an inwardly extending flange or shoulder 527 of reduced I.D. which extends below the lower terminal end of sleeve 513. An annular space 529 is formed between outer sleeve 526 and inner mandrel 512, below flange 527.

A lock ring 530 resides in annular space 529. Lock ring 530 has a ratchet surface 531 on its I.D. which mates with ratchet surface 520, and is held in locked position about its circumference by an overlying portion of outer sleeve 526. Lock ring 530 is held at its upper end by the lower face of flanged portion 527. Lock ring 530 is not a split ring and it is not designed to be released.

Outer sleeve 526 is threaded on a lower portion of its I.D. to a pin end on an upper slip actuating sub 531 and is also secured thereto by a plurality of set screws 532 which reside in a recess 535 on the outer surface of upper slip actuating sub 531. The upper end of upper sub 531 is disposed in annular space 529 and engages the lower terminal end of lock ring 530. The lower end of upper slip actuating sub 531 has a downwardly and outwardly facing frustoconical ramp or cam surface 532. Surface 532 is designed to engage a correlatively shaped surface on a plurality of slip bodies, e.g., inwardly and upwardly facing surface 535 on slip body 536. Each slip body includes a pair of slip surfaces, for example, slip surfaces 537 and 539 of slip body 536. Each slip surface has a plurality of teeth capable of biting into a casing wall or a well bore when the slip bodies are actuated as described below.

Upper slip actuating sub 531 also has a shoulder 540 on its outer surface, just above ramp surface 532. Shoulder 540 extends outwardly from sub 531 and is engageable with a mating shoulder 541, which is formed below an upper end portion of reduced I.D. on the upper, inner surface of a slip cage 542.

Slip cage 542 telescopes over the lower part of upper slip actuating sub 531. Slip cage 542 has a plurality of pairs of windows, for example, windows 544, 546, which accommodate the slip surfaces of each slip body. Each slip body 536 has a recess 545 in its mid-portion. A compression spring, for example spring 552, is located between the end wall 547 of recess 545 and inside wall portion 548 of slip cage 542, and retracts slip body 536 into a position where slip surfaces 537, 539 are substantially out of engagement with the casing or well bore prior to actuation.

The lower end of slip cage 542 has a box threaded to a pin end of a slip cage end ring 552 of smaller I.D. than slip cage 542, forming a shoulder 554. Shoulder 554 abuts a correlatively shaped shoulder 556 around the O.D. of a lower slip actuating sub 558. Shoulders 554 and 556, as well as shoulders 540 and 541, capture slip cage 542 on upper sub 531 and lower sub 558. It should be noted, however, that slip cage 542, slip bodies 536, and subs 558 and 531 can all move axially with respect to mandrel 512 to some extent, after pins 528 are sheared, in order to set the slips and energize the seals.

Lower slip actuating sub 558 has an upwardly and outwardly facing frustoconical ramp or cam surface 560 around its upper end. Surface 560 engages a correlatively shaped surface 562, downwardly and inwardly facing, on the lower side of slip bodies 536. A plurality of circumferentially spaced apart pins 564 extend through lower actuating sub 558 in the area inwardly of slip cage end ring 552. Each pin 564 extends into an axially extending slot 566 in the O.D. surface of inner mandrel 512. Pins 564 can travel axially in slots 566; thus lower actuating sub 558 is free to move axially with respect to mandrel 512 to the limits of slots 566.

The lower portion 568 of lower actuating sub 558 is of expanded I.D. so as to form an annular space 559 around inner mandrel 512. A pin end 570 on the lower portion 568 is threaded to a box end 573 of a seal element actuating ring body 572. Seal element actuating ring body 572 abuts the upper end of a stack of annular packer sealing members 574, which again are preferably made of an elastomer such as rubber.

Two pairs of annular seals 576 and 578 reside in two pairs of annular grooves 577 and 579, respectively, in the I.D. surface of sub 558. Seals 576 seal between the upper portion of lower sub 558 and inner mandrel 512, and seals 578 seal between an element mandrel 582 disposed around the inner peripheries of sealing members 574 and lower portion 568 of sub 558. The upper end of element mandrel 582 extends into annular space 559, and slidingly engages on its O.D. the I.D. surface of lower portion 568 of lower sub 558. The I.D. surface of the upper portion of sub 558 slidingly engages the O.D. surface of mandrel 512.

Element mandrel 582 is prevented from upward axial movement by a shoulder 584 on inner mandrel 512, and from downward axial movement by end sub 522. The lower portion of lower sub 558 telescopes over the upper portion of element mandrel 582. Packer seal members 574 are bonded to the outer surface of element mandrel 582, and are disposed between actuating ring body 572 and end sub 522.

Referring to FIGS. 22–23, packer 500 is shown in the actuated or set position. Outer sleeve 526 has been moved down, shearing pins 528 and causing shoulder 529 to carry down lock ring 530. This also pushes down upper slip actuating sub 531. This in turn pushes the slip bodies, e.g., slip body 536, downwardly and outwardly, due to engagement of the correlating surfaces 532, 535 and 562, 560. Thus, the slip surfaces, e.g. surfaces 537, 539, are forced to engage a casing or well bore wall 586. In addition, lower actuating sub 558 and actuating ring body 572 are pushed down, with mandrel 512 held virtually stationary, so as to compress packer seal elements 574 between actuating ring body 572 and end sub 522. Lower actuating sub 558 can telescope further over element mandrel 582 as it moves down. Packer seal elements 574 are forced radially outwardly and into contact with the casing wall or the inside of the well bore 586, compressed between actuating ring body 572 and end sub 522.

When packer 500 is set, an additional energizing force will be applied to packer seal elements 574 regardless of whether fluid pressure is applied to the packer from above or below. When pressure is applied from below packer 500 (with the inner mandrel bore sealed off), the additional seal energizing force will be equal to the cross-sectional area of inner mandrel 512 multiplied by the applied fluid pressure. When the fluid pressure is applied from above (again with the inner mandrel bore sealed off), the additional seal energizing force will be equal to the difference in cross-sectional areas between seals 578 and 576, that is, the cross-sectional area of the element mandrel, multiplied by the applied fluid pressure. The additional seal energizing force resulting from pressure applied from below acts through mandrel 512 and end sub 522; the oppositely directed additional seal energizing force resulting from pressure applied from above acts through sub 558 and actuating ring 572. It will be appreciated that the direction in which the additional energizing force resulting from the inner mandrel cross-sectional area acts is reversed from the case of the releasable packers described above. Similarly, the direction in which the additional energizing force resulting from the element mandrel cross-sectional area acts is reversed from the case of the releasable packers discussed above.

Figure 24:
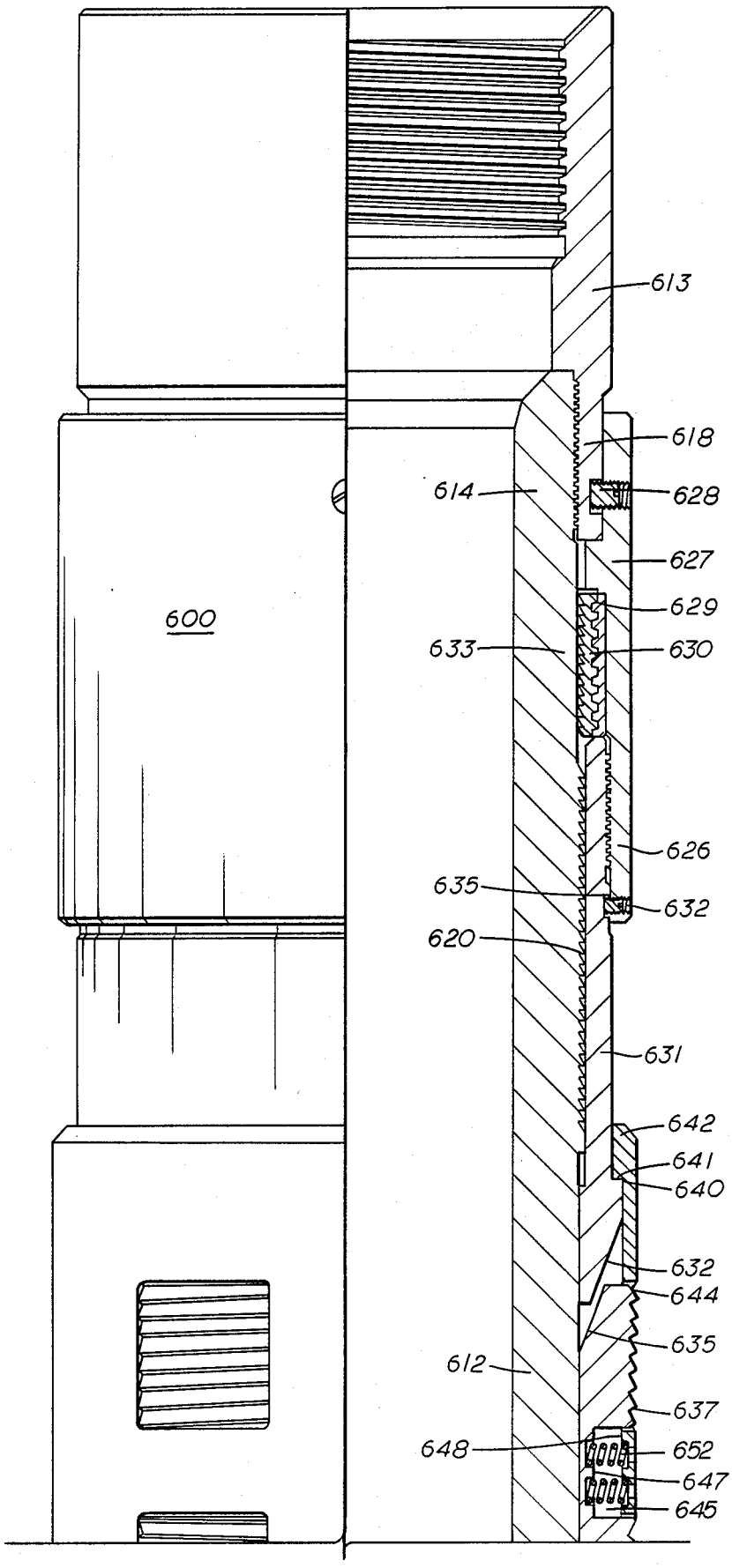
FIGS. 24–25 are partially sectional side elevational views of another embodiment of a sump packer of the invention in the running in position.
Figure 25:
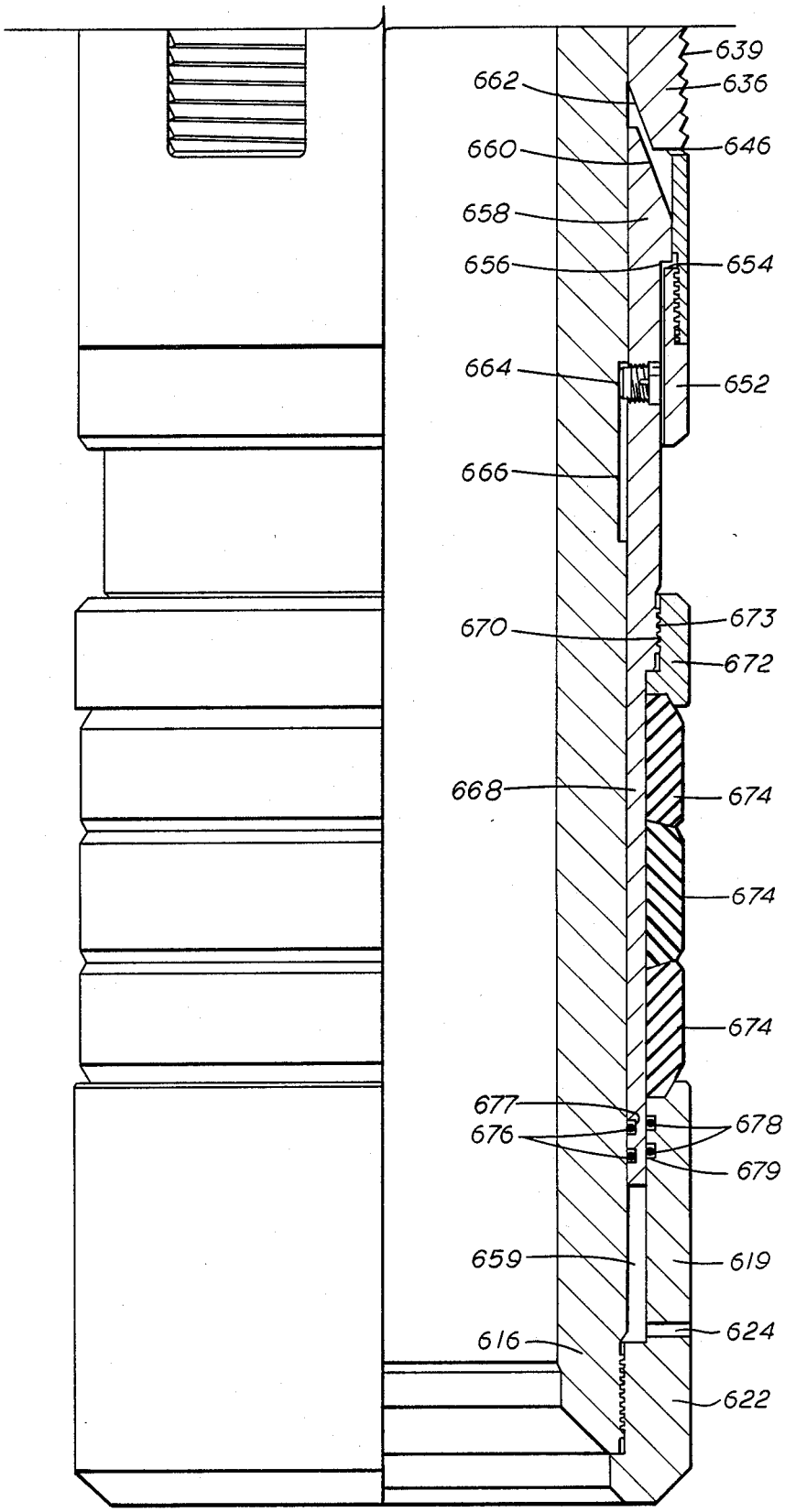
Figure 26:
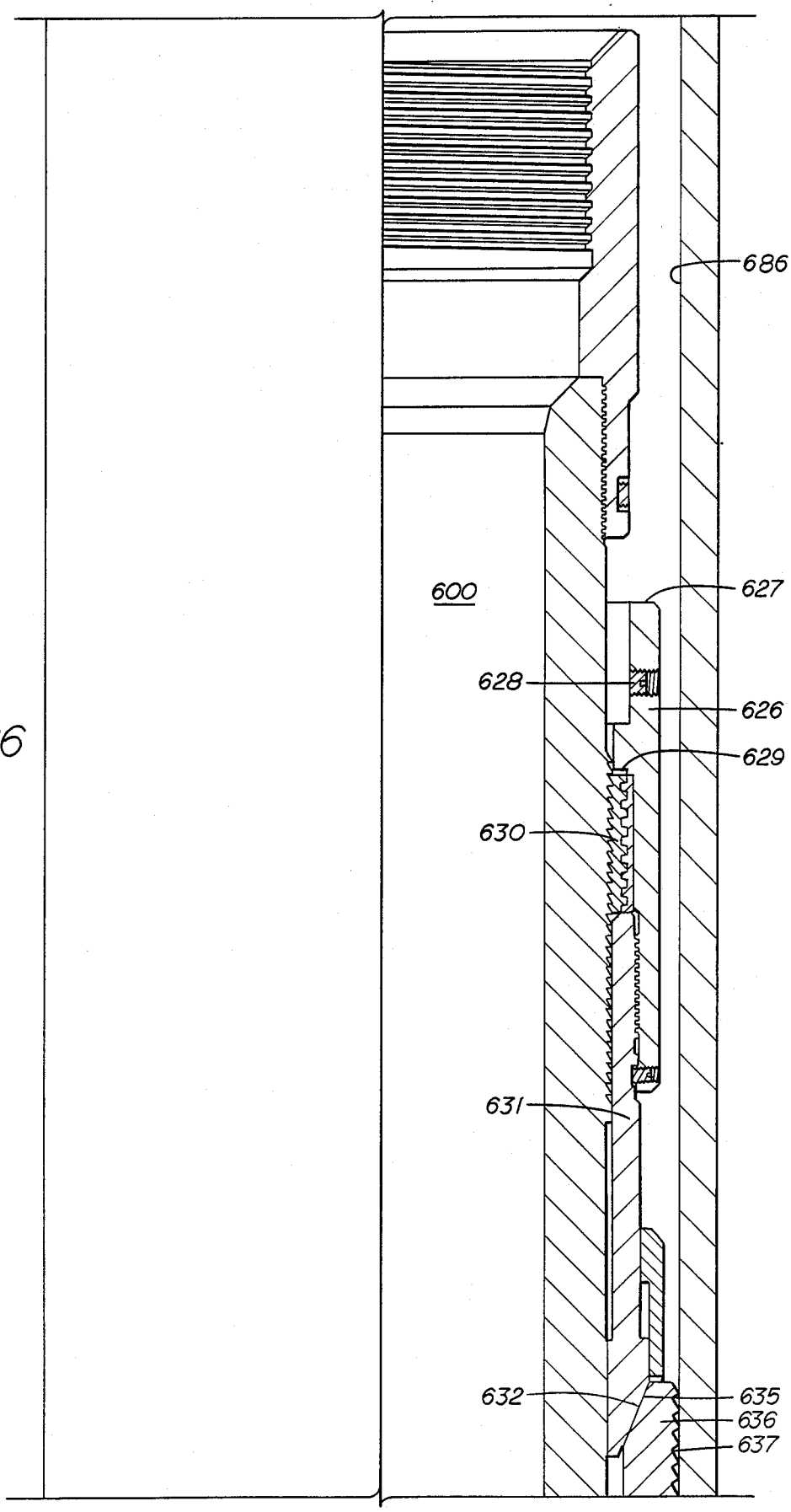
FIGS. 26–27 the sump packer of FIGS. 24–25 in the actuated position.
Figure 27:
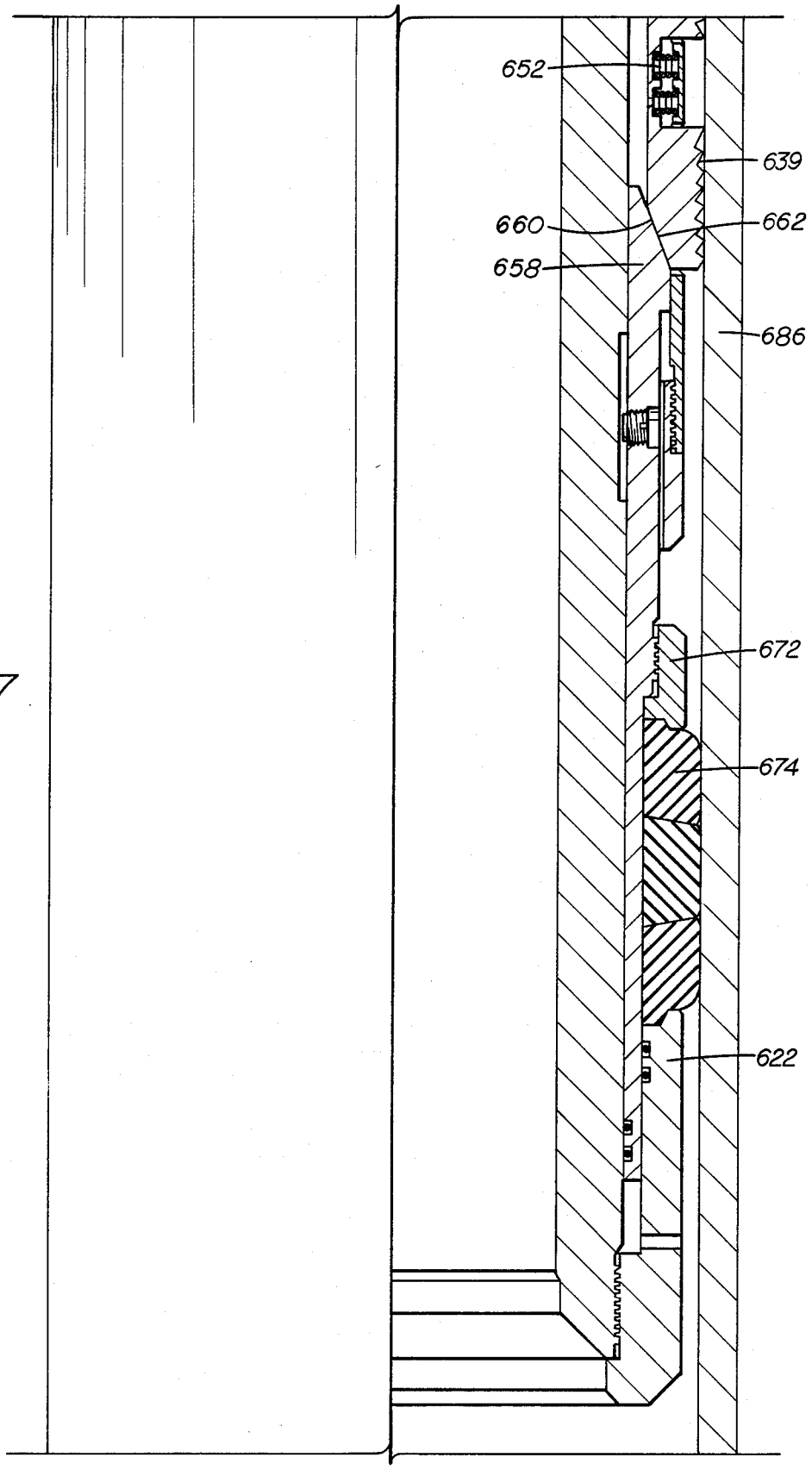

FIGS. 24–25 illustrate another embodiment of a sump packer 600 of the invention in the running in position, and FIGS. 26–27 show packer 600 in the set or actuated position. Referring to FIGS. 24–25, sump packer 600 has an elongated tubular inner mandrel 612 with externally threaded upper and lower pin ends 614 and 616, respectively. Pin end 614 threads to an internally threaded box end 618 on a sleeve 613 having an O.D. larger than that of inner mandrel 612.

Inner mandrel 612 has a ratchet surface 620 around a portion of its external surface below pin end 614. Lower pin end 616 of inner mandrel 612 is threaded to an end sub 622. The lower end of sub 622 forms the bottom of packer 600. An upper portion 619 of end sub 622 is of increased I.D. End sub 622 has a radial bore 624 extending through the lower end of increased I.D. portion 619.

An outer sleeve 626 is telescoped over the lower portion of sleeve 613 and extends axially along a portion of inner mandrel 612. A plurality of circumferentially spaced apart shear pins 628 secure outer sleeve 626 to sleeve 613. Outer sleeve 626 has an inwardly extending flange or shoulder 627 of reduced I.D. which extends below the lower terminal end of sleeve 613. An annular space 629 is formed below shoulder 627 and between outer sleeve 626 and inner mandrel 512.

A lock ring 630 resides in annular space 629. Lock ring 630 has a ratchet surface 633 on its I.D. which mates with ratchet surface 620, and is held in locked position about its circumference by an overlying portion of outer sleeve 626. Lock ring 630 is held at its upper end by the lower face of flange 627. Lock ring 630 is not a split ring and it is not designed to be released.

Outer sleeve 626 is threaded on a lower portion of its I.D. to a pin end on an upper slip actuating sub 631, and is also secured thereto by a plurality of set screws 632 which reside in a recess 635 on the outer surface of upper slip actuating sub 631. The upper end of upper sub 631 is disposed in annular space 629 and engages the lower terminal end of lock ring 630. The lower end of upper sub 631 has a downwardly and outwardly facing frustoconical ramp or cam surface 632. Surface 632 is designed to engage a correlatively sloping surface on a plurality of slip bodies, e.g., surface 635 on slip body 636. Each slip body includes a pair of slip surfaces, for example, surfaces 637 and 639 of slip body 636. Each slip surface has a plurality of teeth capable of biting into a casing wall or a well bore when the slip bodies are actuated as described below.

Upper slip actuating sub 631 also has a shoulder 640 on its outer surface, just above ramp surface 632. The upper portion of a slip cage 642 telescopes over the lower portion of upper slip actuating sub 631. The upper end portion of slip cage 642 has a reduced I.D. such that a shoulder 641 is formed around its inner periphery. Shoulder 641 is engageable with shoulder 640 on the upper slip actuating sub 631.

Slip cage 642 has a plurality of pairs of windows, for example, windows 644, 646, which accommodate the slip surfaces of each slip body. Each slip body has a recess 645 in its mid-portion A pair of compression springs 652 are located between the end wall 647 of recess 645 and inside wall portion 648 of slip cage 642, and retract slip body 636 into a position where slip surfaces 637, 639 are substantially out of engagement with the casing wall or well bore prior to actuation.

The lower end of slip cage 642 has a box threaded to a pin end of a slip cage end ring 652 of smaller I.D. than slip cage 642, forming a shoulder 654. Shoulder 654 abuts a correlatively shaped shoulder 656 around the O.D. of a lower slip actuating sub 658. Shoulders 654 and 656, as well as shoulders 640, 641, capture slip cage 642 on upper sub 631 and lower sub 658. It should be noted, however, that slip cage 642, slip bodies 636, and subs 658, 631 can all move axially with respect to inner mandrel 612 to some extent, after pins 628 are sheared, in order to set the slips and energize the seals.

Lower sub 658 has an upwardly and outwardly facing frustoconical ramp or cam surface 660 around its upper end. Surface 660 engages a correlatively shaped surface 662, downwardly and inwardly facing, on the lower side of slip bodies 636. A plurality of circumferentially spaced apart pins 664 extend through lower actuating sub 658 in the area inwardly of slip cage end ring 652. Each pin 664 extends into an axially extending slot 666 in the O.D. surface of inner mandrel 612. Pins 664 can travel axially in slots 666 so that sub 658 is free to move axially to the limits of slots 666.

The lower portion 668 of lower actuating sub 658 is of decreased O.D. and is slidably received in annular space 659 formed inwardly of portion 619 of end sub 622. This lower extension 668 of sub 658 acts as an element mandrel for packer 600. External threads 670 on the mid-portion of sub 658 are threaded to a box 673 of a seal element actuating ring body 672. Seal element actuating ring body 672 abuts the upper end of the stack of packer sealing elements 674, which, again, are preferably made of an elastomer, e.g., rubber.

Two pairs of annular seals 676, 678, reside in two pairs of annular grooves 677, 679, respectively, and seal between the I.D. of lower portion or element mandrel 668 of sub 658 and the O.D. of inner mandrel 612, and between the O.D. of lower portion or element mandrel 668 and the I.D. of portion 619 of end sub 622.

Packer seal members 674 are bonded to the outer surface of lower portion 668 of lower slip actuating sub 658. Seal members 674 are located between actuating ring body 672 and end sub 622.

Referring to FIGS. 26–27, packer 600 is shown in the actuated or set position. Outer sleeve 626 has been moved down, shearing pins 628 and causing shoulder 629 to carry down lock ring 630, and also pushing down upper slip actuating sub 631. This in turn pushes the slip bodies, e.g., slip body 636, downwardly and outwardly, due to the engagement of cam surfaces 632, 635 and 662, 660, and causes the gripping surfaces 637, 639 to engage the casing or well bore wall 686. The springs 652 are compressed by outward movement of the slips. In addition, lower actuating sub 658 and actuating ring body 672 are pushed down, with mandrel 612 held stationary, so as to compress packer seal elements 674 between actuating ring body 672 and end sub 622. Packer seal elements 674 are forced radially outwardly and into contact with the casing wall or the inside of the well bore 686.

It can be seen from FIGS. 26–27 that in the actuated position, if fluid pressure is applied from above packer 600 (with the central bore of inner mandrel 612 sealed off), the pressure on the cross-section of packer 600 is balanced everywhere except on the cross-sectional area between the seals 676 and 678. Thus, an additional energizing force acting downwardly on lower sub 658 results, which is transferred to seal elements 674 through ring body 672. This additional force acts to further compress and energize packer seal members 674, and is equal to the difference in cross-sectional area between the seals 676 and 678, i.e., the area of lower portion or element mandrel 668 of lower sub 658, multiplied by the applied fluid pressure.

When fluid pressure is applied from below packer 600 (again with the central bore of inner mandrel 612 sealed off), the pressure on the cross-section of packer 600 is balanced everywhere except on the inner mandrel 612. Thus, there is a net additional energizing force acting upwardly on seal elements 674 through mandrel 612 and end sub 622, thereby further compressing and energizing packer seal members 674. This additional energizing force is equal to the cross-sectional area of inner mandrel 612 multiplied by the applied fluid pressure.

Referring again to the actuated position of packer 500 shown in FIGS. 22 and 23, it can be seen that fluid pressure applied from above or below will have the same net additional energizing effect as it does on packer 600.

In order to place a gravel pack in a well bore and isolate the gravel pack with a sump packer and a releasable packer of the invention, the following steps are performed. After location of a producing zone by conventional techniques, a sump packer of the invention (e.g., sump packer 500 or 600) is run into the well bore on an electric wire line to an area below the zone. Use of an electric wire line in the running in operation allows for accurate placement of the sump packer. Once in position, the slips are set to lock the sump packer into place and the packer seal elements are actuated to seal against the inside of the casing or well bore. The gravel pack can now be run into the well to the point where it latches into the sump packer, thereby accurately positioning the screen at the level of the producing zone so that fluid flowing from the producing zone must pass through the gravel pack before entering the production pipe. Thereafter, a releasable packer, e.g., packer 100 or 300, is run into the well to the point where it latches into the gravel pack. At that point the releasable packer is set or actuated, so that the slips lock the packer into place, and the seal elements seal against the casing wall or well bore.

Once the entire system is in place, it can be seen that the producing zone is isolated between the two packers. Perforation may then be performed, and production begun. All fluid entering the production pipe then flows through the gravel pack.

It should be noted that the packers of the invention can be used with a variety of gravel pack systems, including the All Up Gravel Pack System described in co-pending U.S. Pat. Application Serial No. 07/224,974. This gravel pack system allows performing a variety of operations once the system is in place. These operations include a lower squeeze operation, a lower circulation operation, an upper squeeze operation, an upper circulation operation, and a reverse circulation or a variation thereof. The specific additional apparatus needed to perform these operations is disclosed in U.S. Pat. Application Serial No. 07/224,974, incorporated herein by reference.

It should be understood that the foregoing terms and descriptions are exemplary only and not limiting, and that the scope of the protection is limited only by the claims which follow and includes all equivalents of the subject matter of those claims.

I claim:

1. A packer for sealing the annulus between a string of pipe in a well and the wall of a casing or well bore surrounding the pipe string, comprising:

a tubular inner mandrel;

a tubular element mandrel disposed around said inner mandrel;

packer sealing means disposed on the outer circumferential periphery of said element mandrel for sealingly engaging the wall of the casing or well bore when energized;

a first shoulder disposed on said packer in engagement with one end of said packer sealing means;

a tubular shoe body slidingly disposed on said element mandrel and said inner mandrel, said shoe body having a second shoulder on one end in engagement with the other end of said packer sealing means, said first and second shoulders being movable toward one another to compress said packer sealing means between them and expand said packer sealing means radially into sealing engagement with said casing or well bore wall, said shoe body being in telescoping engagement with the outer surface of said element mandrel on said one end and the outer surface of said inner mandrel on its other end;

latch means for preventing substantial separation of said first and second shoulders when said packer sealing means is energized;

first self-energizing seal means disposed on one of said shoe body and said element mandrel at said one end of said shoe body for sealingly engaging the other of said shoe body and said element mandrel;

second self-energizing seal means disposed on one of said shoe body and said inner mandrel at said other end of said shoe body for sealingly engaging the other of said shoe body and said inner mandrel; and slip means disposed on said inner mandrel for anchoring said packer to said casing or well bore wall when actuated.

2. A packer according to claim 1, and further including an outer sleeve disposed around and releasably connected to said inner mandrel, said outer sleeve having said first shoulder disposed thereon and being axially movable with respect to said inner mandrel when said releasable connection is released.

3. A packer according to claim 2, wherein the upper end of said element mandrel is affixed to the lower end of said outer sleeve, and said outer sleeve above said element mandrel has an inside diameter larger than the outside diameter of said inner mandrel forming an annular space therebetween, said latch means being disposed in said annular space.

4. A packer according to claim 3, wherein the outside surface of said inner mandrel includes a ratchet surface along a portion of the axial extent of said annular space, and said latch means includes a split lock ring disposed in said annular space around said inner mandrel, said split lock ring having a ratchet surface around its inner periphery which is lockingly engageable with said ratchet surface of said inner mandrel, said lock ring being movable by said outer sleeve between a running position out of engagement with said ratchet surface of said inner mandrel and a latched position in engagement with said ratchet surface of said inner mandrel when said outer sleeve is moved axially on said inner mandrel.

5. A packer according to claim 4, wherein said outer sleeve is connected to said inner mandrel in a raised position by shearable means when said packer is run into the well, said lock ring being held in said running position out of engagement with said ratchet surface of said inner mandrel during such run in of said packer, said outer sleeve being movable to a lowered position when said shearable means has been sheared, said outer sleeve carrying said lock ring to said latched position when lowered.

6. A packer according to claim 5, wherein said outer sleeve includes a lower sleeve portion rigidly affixed to said element mandrel and an upper sleeve portion telescoped onto said lower sleeve portion and releasably connected thereto with second shearable means, said upper sleeve portion being permitted to move axially to a limited extent with respect to said lower sleeve portion when said second shearable means has been sheared, and further including a release sleeve disposed in said annular space and movable into camming engagement with said lock ring to force the ratchet surface of said lock ring away from locking engagement with the ratchet surface of said inner mandrel when said upper sleeve portion is moved upwardly with respect to said lower sleeve portion.

7. A packer according to claim 6, wherein upward movement of said upper sleeve portion moves said lower sleeve portion and said element mandrel upwardly along with it when said upper sleeve portion reaches its upper travel limit on said lower sleeve portion.

8. A packer according to claim 7, wherein said lower sleeve portion includes an extension sleeve member disposed thereon and having an axially extending slot therethrough, said extension sleeve being disposed between said release sleeve and said upper portion of said outer sleeve, said upper sleeve portion including an inwardly extending pin disposed thereon, said pin extending through said slot in said extension sleeve and attached to said release sleeve.

9. A packer according to claim 1, wherein said shoe body includes an upper shoe body having said first self-energizing seal means disposed thereon and a lower shoe body having said second self-energizing seal means disposed thereon, said upper shoe body being sealingly connected to said lower shoe body.

10. A packer according to claim 9, wherein said upper shoe body includes an upper portion sealingly, slidably disposed on the outside surface of said element mandrel and a lower portion of increased inside diameter extending downwardly from said upper portion, said lower portion of said upper shoe body being spaced from the outside surface of said inner mandrel, and said lower shoe body includes a lower portion sealingly, slidably disposed on the outside surface of said inner mandrel and an upper portion of increased inside diameter, said upper portion of said lower shoe body being threadedly received within said lower portion of said upper shoe body, there being an annular space between said upper portion of said lower shoe body and the outer surface of said inner mandrel, the lower end portion of said element mandrel being slidably received in said annular space between said upper portion of said lower shoe body and said inner mandrel.

11. A packer according to claim 10, wherein said lower end portion of said element mandrel includes a plurality of longitudinally axially extending splines on its outer surface, said splines being engageable with a plurality of longitudinally axially extending splines disposed on the inside surface of said upper portion of said lower shoe body, whereby said element mandrel is antirotationally connected to said lower shoe body.

12. A packer according to claim 10, wherein said slip means includes a slip cage disposed around said inner mandrel below said lower shoe body, and including a plurality of slip bodies disposed in said slip cage and circumferentially spaced around said inner mandrel, said lower shoe body having attached thereto an upper slip actuating sub extending into said slip cage and axially movable with respect thereto to a limited extent, said inner mandrel including a lower slip actuating sub affixed thereto and extending into said slip cage, said slip cage being axially movable with respect to said lower slip actuating sub to a limited extent, said upper and lower slip actuating subs having camming surfaces engageable with said slip bodies for actuating said slip bodies into anchoring engagement with the casing or well bore wall, said camming surfaces actuating said slip bodies when said camming surfaces are forced toward one another in said slip cage.

13. A packer according to claim 12, wherein said slip cage has an inwardly extending shoulder on its upper end and on its lower end, said shoulders being engageable with correlatively shaped shoulders on the upper and lower slip actuating subs to prevent the axial separation of said slip actuating subs and said slip cage.

14. A packer according to claim 13, wherein said upper slip actuating sub has a plurality of longitudinally axially extending splines on its outer surface which are engageable with a plurality of correlatively shaped, longitudinally axially extending splines on the upper inside surface of said slip cage, whereby said upper slip actuating sub is antirotationally connected to said slip cage.

15. A packer according to claim 10, wherein said slip means includes a slip cage disposed around said inner mandrel below said lower shoe body, and including a plurality of slip bodies disposed in said slip cage and circumferentially spaced around said inner mandrel, said lower shoe body extending into said slip cage and being axially movable with respect thereto to a limited extent, said inner mandrel including a lower slip actuating sub affixed thereto and extending into said slip cage, said slip cage being axially movable with respect to said lower slip actuating sub to a limited extent, said lower shoe body and said lower slip actuating sub having camming surfaces engageable with said slip bodies for actuating said slip bodies into anchoring engagement with the casing or well bore wall, said camming surfaces actuating said slip bodies when said camming surfaces are forced toward one another in said slip cage.

16. A packer according to claim 15, wherein said slip cage has an inwardly extending shoulder on its upper end and on its lower end, said shoulders being engageable with correlatively shaped shoulders on the lower shoe body and lower slip actuating sub to prevent the axial separation of said lower shoe body, said lower slip actuating sub, and said slip cage.

17. A packer according to claim 15, wherein said lower shoe body has a plurality of longitudinally axially extending splines on its outer surface which are engageable with a plurality of correlatively shaped, longitudinally axially extending splines on the upper inside surface of said slip cage, whereby said lower shoe body is antirotationally connected to said slip cage.

18. A packer according to claim 1, wherein an end sub is disposed on the lower end of said inner mandrel, the upper end of said end sub including said first shoulder, said first shoulder engaging the lower end of said packer sealing means, said element mandrel being retained on said inner mandrel between said first shoulder of said end sub and an outwardly extending shoulder on said inner mandrel above and in engagement with the upper end of said element mandrel.

19. A packer according to claim 18, wherein said shoe body includes a lower portion sealingly, slidably disposed on the outside surface of said element mandrel, said lower portion of said shoe body including said first self-energizing seal means and having said second shoulder attached thereto, and an upper portion of decreased inside diameter sealingly, slidably disposed on the outside surface of said inner mandrel, said upper portion of said shoe body including said second self-energizing seal means.

20. A packer according to claim 19, wherein said slip means includes a slip cage disposed around said inner mandrel above said upper portion of said shoe body, and including a plurality of slip bodies disposed in said slip cage and circumferentially spaced around said inner mandrel, said upper portion of said shoe body extending into said slip cage and being axially movable with respect thereto to a limited extent, and including an upper slip actuating sub releasably connected to said inner mandrel and extending into said slip cage, said upper slip actuating sub being axially movable with respect to said slip cage to a limited extent, said upper portion of said shoe body and said upper slip actuating sub having camming surfaces engageable with said slip bodies for actuating said slip bodies into anchoring engagement with the casing or well bore wall, said camming surfaces actuating said slip bodies when said camming surfaces are forced toward one another in said slip cage.

21. A packer according to claim 20, wherein said upper slip actuating sub is affixed to an outer sleeve disposed around said inner mandrel, said outer sleeve being connected to said inner mandrel in a raised position by shearable means when said packer is run into the well, said upper slip actuating sub being moved downwardly with respect to said inner mandrel when said outer sleeve is forced downwardly to shear said shearable means, the camming surface of said upper slip actuating sub being forced into said slip cage toward said camming surface of said upper shoe body portion to actuate said slip bodies, said slip cage being forced downwardly along with said upper slip actuating sub and said upper shoe body portion, said lower shoe body portion being forced downwardly along with said upper shoe body portion to compress said packer sealing means between said first and second shoulders to energize said packer sealing means.

22. A packer according to claim 21, wherein said outer sleeve has an inside diameter along a portion of its length which is larger than the outside diameter of said inner mandrel forming an annular space therebetween, said latch means being disposed in said annular space.

23. A packer according to claim 22, wherein the outside surface of said inner mandrel includes a ratchet surface along a portion of the axial extent of said annular space, and said latch means includes a lock ring disposed in said annular space around said inner mandrel, said lock ring having a ratchet surface around its inner periphery which is lockingly engageable with said ratchet surface of said inner mandrel, said lock ring being movable by said outer sleeve from a running position out of engagement with said ratchet surface of said inner mandrel to a latched position in engagement with said ratchet surface of said inner mandrel when said outer sleeve is moved downwardly on said inner mandrel upon shearing of said shearable means.

24. A packer according to claim 20, wherein said slip cage has an inwardly extending shoulder on its upper end and on its lower end, said shoulders being engageable with correlatively shaped shoulders on the upper portion of the shoe body and the upper slip actuating sub to prevent the axial separation of said shoe body, said slip cage, and said upper slip actuating sub.

25. A packer according to claim 24, wherein said inner mandrel has an axially extending slot in its outer surface and said upper shoe body portion has an inwardly extending pin thereon, said pin riding in said slot.

26. A packer for sealing the annulus between a string of pipe in a well and the wall of a casing or well bore surrounding the pipe string, comprising:

a tubular inner mandrel having an elongate body and an annular end sub affixed to its lower end, said annular end sub having an upwardly extending upper portion surrounding the mandrel body with an inside diameter greater than the outside diameter of the mandrel body, forming an annular space between the upper portion of the end sub and the mandrel body;

a tubular element mandrel slidingly disposed around said inner mandrel, said element mandrel having a lower end portion telescopingly received in said annular space;

packer sealing means disposed on the outer circumferential periphery of said element mandrel for sealingly engaging the wall of the casing or well bore when energized;

said end sub comprising a first shoulder for engaging one end of said packer sealing means;

the upper portion of said element mandrel above said packer sealing means comprising a second shoulder for engaging the other end of said packer sealing means, said first and second shoulders being movable toward one another to compress said packer sealing means between them and expand said packer sealing means radially into sealing engagement with said casing or well bore wall;

latch means for preventing substantial separation of said first and second shoulders when said packer sealing means is energized;

first self-energizing seal means disposed on one of said lower end portion of said element mandrel and said end sub for sealingly engaging the other of said lower end portion of said element mandrel and said end sub;

second self-energizing seal means disposed on one of said lower end portion of said element mandrel and said mandrel body for sealingly engaging the other of said lower end portion of said element mandrel and said mandrel body; and slip means disposed on said inner mandrel for anchoring said packer to said casing or well bore wall when actuated.

27. A packer according to claim 26, wherein said slip means includes a slip cage disposed around said inner mandrel body above said packer sealing means, and including a plurality of slip bodies disposed in said slip cage and circumferentially spaced around said inner mandrel body, said upper portion of said element mandrel above said second shoulder extending into said slip cage and being axially movable with respect thereto to a limited extent, and including an upper slip actuating sub releasably connected to said inner mandrel body and extending into said slip cage, said upper slip actuating sub being axially movable with respect to said slip cage to a limited extent, said upper portion of said element mandrel which extends into said slip cage and said slip actuating sub having camming surfaces engageable with said slip bodies for actuating said slip bodies into anchoring engagement with the casing or well bore wall, said camming surfaces actuating said slip bodies when said camming surfaces are forced toward one another in said slip cage.

28. A packer according to claim 27, wherein said upper slip actuating sub is affixed to an outer sleeve disposed around said inner mandrel body, said outer sleeve being connected to said inner mandrel body in a raised position by shearable means when said packer is run into the well, said upper slip actuating sub being moved downwardly with respect to said inner mandrel body when said outer sleeve is forced downwardly to shear said shearable means, the camming surface of said upper slip actuating sub being forced into said slip cage toward said camming surface of said element mandrel to actuate said slip bodies, said slip cage being forced downwardly along with said upper slip actuating sub and said element mandrel to compress said packer sealing means between said first and second shoulders to energize said packer sealing means.

29. A packer according to claim 28, wherein said outer sleeve has an inside diameter along a portion of its length which is larger than the outside diameter of said inner mandrel body forming a second annular space therebetween, said latch means being disposed in said annular space.

30. A packer according to claim 29, wherein the outside surface of said inner mandrel body includes a ratchet surface along a portion of the axial extent of said second annular space, and said latch means includes a lock ring disposed in said second annular space around said inner mandrel body, said lock ring having a ratchet surface around its inner periphery which is lockingly engageable with said ratchet surface of said inner mandrel body, said lock ring being movable by said outer sleeve from a running position out of engagement with said ratchet surface of said inner mandrel body to a latched position in engagement with said ratchet surface of said inner mandrel body when said outer sleeve is moved downwardly on said inner mandrel body upon shearing of said shearable means.

31. A packer according to claim 27, wherein said slip cage has an inwardly extending shoulder on its upper end and on its lower end, said shoulders being engageable with correlatively shaped shoulders on said upper portion of said element mandrel and said slip actuating sub to prevent the axial separation of said element mandrel, said slip cage, and said slip actuating sub.

32. A packer according to claim 31, wherein said inner mandrel body has an axially extending slot in its outer surface and said upper portion of said element mandrel has an inwardly extending pin thereon, said pin riding in said slot.

* * * * *